US007069916B2

(12) United States Patent
Osanai

(10) Patent No.: US 7,069,916 B2
(45) Date of Patent: Jul. 4, 2006

(54) EVAPORATIVE FUEL TREATMENT APPARATUS FOR INTERNAL COMBUSTION ENGINE

(75) Inventor: Akinori Osanai, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/935,113

(22) Filed: Sep. 8, 2004

(65) Prior Publication Data

US 2005/0056262 A1 Mar. 17, 2005

(30) Foreign Application Priority Data

Sep. 12, 2003 (JP) ..... 2003-321938
Oct. 16, 2003 (JP) ..... 2003-356360
Oct. 16, 2003 (JP) ..... 2003-356420

(51) Int. Cl.
*F02M 37/04* (2006.01)

(52) U.S. Cl. ..... 123/516; 123/524

(58) Field of Classification Search ..... 123/523, 123/524, 525, 516, 518, 519, 520, 198 D
See application file for complete search history.

(56) References Cited

U.S. PATENT DOCUMENTS 4,706,636 A * 11/1987 Davis ..... 123/557
4,829,968 A * 5/1989 Onufer ..... 123/518
5,275,145 A * 1/1994 Tuckey ..... 123/521
5,850,821 A * 12/1998 Curtis ..... 123/524
6,182,693 B1 * 2/2001 Stack et al. ..... 137/565.17
6,189,516 B1 * 2/2001 Hei Ma ..... 123/524
6,273,072 B1 * 8/2001 Knapstein et al. ..... 123/527
6,591,866 B1 * 7/2003 Distelhoff et al. ..... 137/565.22

FOREIGN PATENT DOCUMENTS

JP 63-248960 A 10/1988
JP 03-23357 A 1/1991
JP 06-323208 A 11/1994
JP 11-36937 A 2/1999
JP 11-280532 A 10/1999

OTHER PUBLICATIONS

Shinsuke Kiyomiya; Toyota Motor Corporation; English translation of "Evaporative Fuel Treatment Equipment"; Journal of Technical Disclosure No. 99-7879; Nov. 1, 1999.

* cited by examiner

*Primary Examiner*—Carl S. Miller
(74) *Attorney, Agent, or Firm*—Oliff & Berridge, PLC

(57) ABSTRACT

A fuel tank is provided with an atmospheric air introduction hole so that the fuel tank communicates with the outside. As a result, the interior of the fuel tank is maintained at a pressure level between substantially atmospheric air pressure and positive pressure. A canister may be connected to the atmospheric air introduction hole. When an internal combustion engine starts up, the fuel tank communicates with an intake path. Internal combustion engine startup places the intake path under negative pressure. Under negative pressure, fuel vapor is supplied to the intake path from the fuel tank whose pressure level is between substantially atmospheric air pressure and positive pressure.

19 Claims, 17 Drawing Sheets

EVAPORATIVE FUEL TREATMENT APPARATUS FOR INTERNAL COMBUSTION ENGINE

BACKGROUND OF THE INVENTION

1. Field of the Invention

The present invention relates to an evaporative fuel treatment apparatus for an internal combustion engine, and more particularly to an evaporative fuel treatment apparatus for an internal combustion engine that supplies evaporative fuel as the fuel for startup.

2. Background Art

A technology disclosed, for instance, by Japanese Patent JP-A No. 280532/1999 (hereinafter referred to as "Patent Document 1") emits fuel vapor (evaporative fuel) adsorbed by a canister, supplies the fuel vapor to a surge tank, and supplies the fuel vapor and fresh air to a combustion chamber at internal combustion engine startup. Since the wall surface temperature is still not high during or immediately after startup, the fuel injected from a fuel injection valve is not likely to evaporate so that stable combustion is not readily accomplished. The fuel vapor exhibits excellent ignitability because it is completely gasified. Therefore, when the fuel vapor is used as the fuel for startup, the startability of an internal combustion engine improves.

Another technology disclosed, for instance, by Japanese Patent JP-A No. 36937/1999 (hereinafter referred to as "Patent Document 2") connects a fuel tank to an intake pipe with an evaporative fuel path and directly supplies fuel vapor in the fuel tank to the intake pipe. This technology aims at maintaining a negative pressure within the fuel tank. This purpose is achieved by regulating the opening of a control valve installed in the evaporative fuel path in accordance with the pressure within the fuel tank with a view toward transferring the fuel vapor from the fuel tank to the intake pipe.

However, the technology disclosed by Patent Document 1 cannot easily adjust the amount of fuel injection from the fuel injection valve. The amount of fuel vapor emission from the canister depends on the amount of fuel vapor adsorption by the canister. In some cases, therefore, only very low concentration fuel vapor may be supplied. In some other cases, very high concentration fuel vapor may be supplied. Under these circumstances, it is necessary to estimate the amount of evaporative fuel adsorption by the canister and control the amount of fuel injection from the fuel injection valve in accordance with the estimation result. The technology disclosed by Patent Document 1 estimates the amount of evaporative fuel adsorption in accordance with the learning value of an air-fuel ratio feedback correction coefficient. At internal combustion engine startup, it estimates the amount of evaporative fuel adsorption in accordance with a learning value determined by feedback control exercised for the last operation. While the internal combustion engine is stopped, however, the fuel vapor may be adsorbed or emitted by the canister. Therefore, the amount of evaporative fuel adsorption estimated from the last learning value may significantly differ from the actual amount of evaporative fuel adsorption. Even if the amount of fuel injection by the fuel injection value is determined according to the amount of evaporative fuel adsorption estimated from the last learning value in the above circumstances, an improper combustion state may occur because a desired amount of fuel cannot be supplied. The use of a sensor makes it possible to measure the fuel vapor concentration, but entails an additional cost.

If, on the other hand, the fuel vapor in the fuel tank is to be supplied to the intake pipe as described in Patent Document 2, the concentration of the fuel vapor can be more or less determined at all times in comparison to the concentration of fuel vapor emission from the canister. However, the technology disclosed by Patent Document 2 emits the fuel vapor into the intake pipe in order to maintain a negative pressure within the fuel tank at all times. Therefore, if a negative pressure already is produced within the fuel tank or prematurely produced, it is impossible to supply a sufficient amount of fuel vapor.

SUMMARY OF THE INVENTION

The present invention has been made to solve the above problems and provides an evaporative fuel treatment apparatus that is capable of improving the startability of an internal combustion engine by supplying fuel vapor of steady concentration at internal combustion engine startup.

In accordance with one aspect of the present invention, the evaporative fuel treatment apparatus for an internal combustion engine comprises a fuel tank for storing fuel; an atmospheric air inlet for causing the fuel tank to communicate with the outside and maintaining the interior of the fuel tank at a pressure level between substantially atmospheric air pressure and positive pressure; and evaporative fuel supply means for causing the fuel tank to communicate with an intake path at internal combustion engine startup and supplying evaporative fuel in the fuel tank to the intake path.

Other objects and further features of the present invention will be apparent from the following detailed description when read in conjunction with the accompanying drawings.

DESCRIPTION OF THE PREFERRED EMBODIMENT

First Embodiment

A first embodiment of the present invention will now be described with reference to FIGS. 1 through 3.

Figure 1:
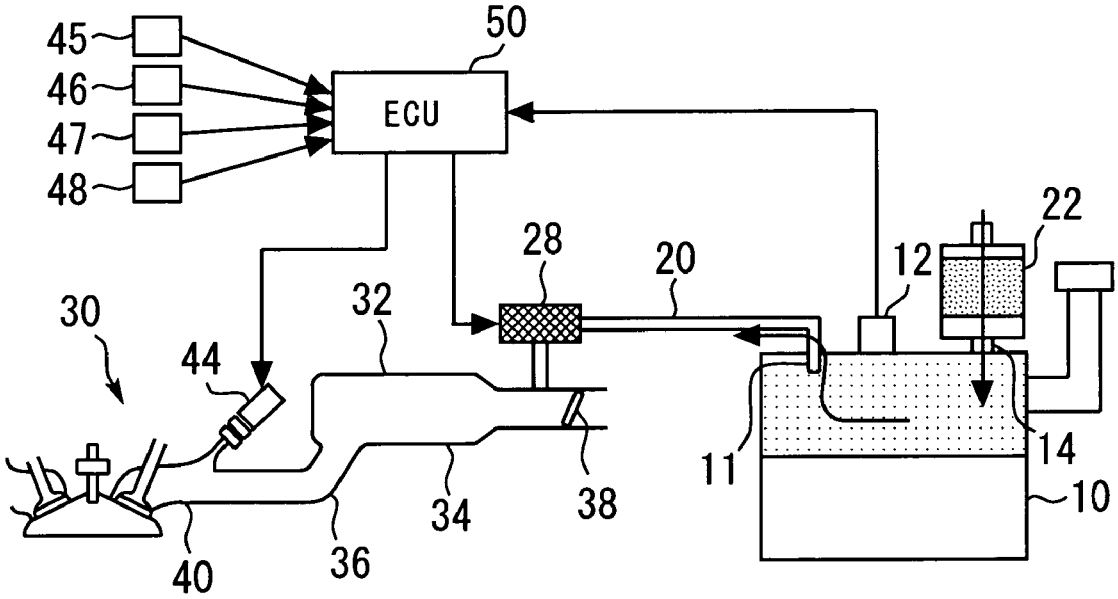
FIG. 1 illustrates the configuration of a first embodiment of an evaporative fuel treatment apparatus according to the present invention.

FIG. 1 schematically illustrates the first embodiment of an evaporative fuel treatment apparatus according to the present invention. The evaporative fuel treatment apparatus according to the present embodiment includes a fuel tank 10. The fuel tank 10 is provided with a tank internal pressure sensor 12, which measures the tank internal pressure. The tank internal pressure sensor 12 detects a tank internal pressure as a relative pressure with respect to the atmospheric pressure, and generates an output according to a detected value.

The fuel tank 10 is provided with a protrusion 11, which protrudes into the fuel tank from a ceiling surface. A vapor path (evaporative fuel path) 20 is connected to the protrusion 11. The vapor path 20 is connected to an intake path 32 of an internal combustion engine 30 and used so that the fuel vapor (evaporative fuel) generated in the fuel tank 10 is removed to the outside. The vapor path 20 is provided with a purge valve (D-VSV: Duty-Vacuum Switching Valve) 28, which regulates the rate of gas flow in the vapor path 20. The purge valve 28 is driven by a duty signal to practically provide an appropriate valve opening in accordance with a duty ratio indicated by the duty signal.

An atmospheric air introduction hole 14 is formed in the fuel tank 10. A canister 22 is connected to the atmospheric air introduction hole 14. One end of the canister is open to the outside. The fuel tank 10 communicates with the outside via the canister 22. The canister is filled with active carbon for adsorbing fuel vapor. A slight degree of pressure loss (several kilopascals) is caused by the installed canister 22. However, even when fuel vapor is removed from the fuel tank 10, the interior of the fuel tank 10 is maintained substantially at atmospheric pressure because atmospheric air is introduced from the atmospheric air introduction hole 14. The atmospheric air introduction hole 14 is positioned apart from the above-mentioned protrusion 11 to ensure that a purge gas flowing into the fuel tank 10 from the canister 22 does not directly flow into the vapor path 20.

A throttle valve 38 for controlling the intake air amount is positioned in the intake path 32 for the internal combustion engine 30. A surge tank 34, which is a volumetric section, is formed downstream of the throttle valve 38 in the intake path 32. The above-mentioned vapor path 20 communicates with the upstream end of the surge tank 34. An intake manifold 36 is connected to the surge tank 34. The intake manifold 36 leads to intake ports 40 for the internal combustion engine 30. A fuel injection valve 44 for injecting fuel into a cylinder is positioned near each intake port 40. A revolving speed sensor 46 for detecting the engine revolving speed and a cooling water temperature sensor 47 for detecting the cooling water temperature are also incorporated in the internal combustion engine 30. Further, an air flow meter 45 for detecting the amount of intake air is positioned upstream of the throttle valve 38 in the intake path 32. An exhaust path, which is not shown, is provided with a catalytic device (not shown) for purifying toxic substances contained in an exhaust gas and an oxygen concentration sensor 48 for detecting the oxygen concentration in the exhaust gas.

The evaporative fuel treatment apparatus shown in FIG. 1 is equipped with an ECU (Electronic Control Unit) 50. The ECU 50 is a controller for the evaporative fuel treatment apparatus. The ECU 50 receives output signals from various sensors described above and supplies drive signals to various actuators. In the present embodiment, the ECU 50 particularly supplies drives signals to the purge valve 28 and fuel injection valve 44. The control operation that the ECU 50 performs for the purge valve 28 will now be described with reference to a flowchart in FIG. 2. The control operation that the ECU 50 performs for the fuel injection valve 44 will also be described with reference to a flowchart in FIG. 3.

Figure 2:
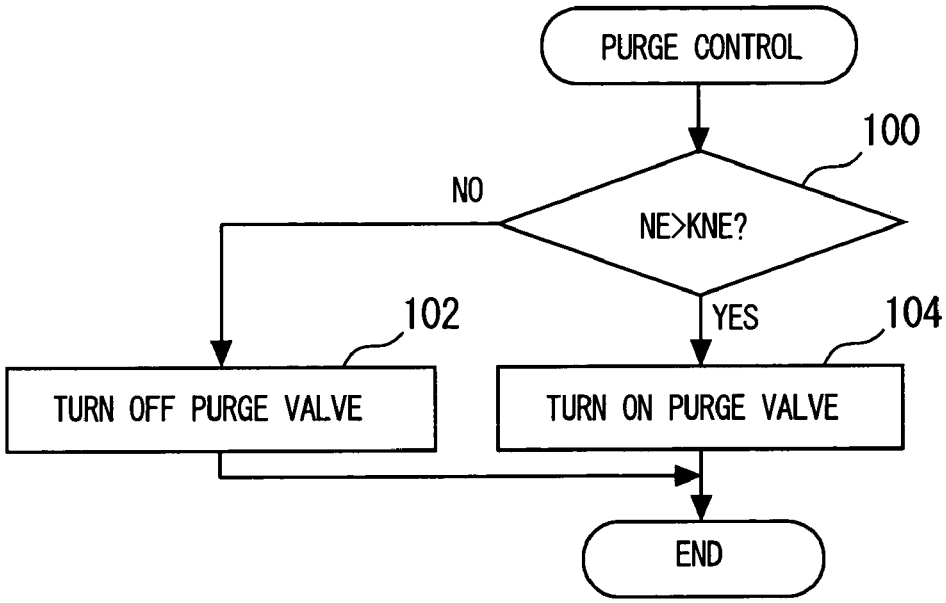
FIG. 2 is a flowchart illustrating a purge control routine that is executed in the first embodiment of the present invention.

FIG. 2 is a flowchart illustrating purge control that is exercised in the present embodiment by the ECU 50, which serves as a controller for the evaporative fuel treatment apparatus. In a routine shown in FIG. 2, the engine revolving speed NE is first detected in accordance with the output of the revolving speed sensor 46 and compared against a predetermined judgment value KNE (step 100). The judgment value KNE represents a revolving speed at which it can be concluded that the internal combustion engine 30 is started up. It is approximately set at a starting revolving speed (e.g., 50 rpm) that is provided by a starter.

If it is found as a result of comparison that the engine revolving speed NE is not greater than the judgment value KNE, the purge valve 28 remains closed to keep the fuel vapor from being discharged because the internal combustion engine 30 is not started up (step 102).

When the engine revolving speed NE exceeds the judgment value, the purge valve 28 opens to discharge the fuel vapor (step 104). When the purge valve 28 is open, the fuel tank 10 communicates with the intake path 32. The interior of the fuel tank 10 is placed substantially at atmospheric pressure. The interior of the intake path 32 is placed under negative pressure. Therefore, the fuel vapor in the fuel tank 10 is sucked into the intake path 32 via the vapor path 20. The fuel vapor is supplied to the surge tank 34 together with fresh air, which is introduced via the throttle valve 38. Further, the fuel vapor is supplied to a combustion chamber for each cylinder when fuel is injected from the fuel injection valve 44. The purge valve 28 is set to fully open for the purpose of supplying as much fuel vapor as possible to the internal combustion engine 30 as startup fuel. While the purge valve 28 is open, the fuel vapor is continuously transferred out of the fuel tank 10. However, the internal pressure within the fuel tank 10 does not decrease because the fuel tank 10 communicates with the outside via the atmospheric air introduction hole 14. In other words, the fuel vapor flow rate does not decrease due to a decrease in the internal pressure within the fuel tank 10.

The canister 22 is positioned in the atmospheric air introduction hole 14. Therefore, when atmospheric air (fresh air) is introduced into the fuel tank 10 via the atmospheric air introduction hole 14, the fuel vapor adsorbed by the canister 22 becomes desorbed and flows into the fuel tank 10 together with the atmospheric air. This purges the canister 22 so that its adsorptive power is maintained. It is highly probable that the fuel vapor discharged from the canister 22 differs from the fuel vapor in the fuel tank 10 in concentration. However, the fuel tank 10 functions as a buffer because it is extremely larger in capacity than the canister 22. Therefore, even if the fuel vapor adsorbed by the canister 22 flows into the fuel tank 10, the fuel vapor supplied from the fuel tank 10 to the intake path 32 does not significantly change its concentration.

According to the purge control routine described above, concentrated fuel vapor in the fuel tank 10 can be supplied to the internal combustion engine 30 from a startup sequence for the internal combustion engine 30. As described earlier, the fuel vapor exhibits higher ignitability than atomized fuel that is injected from the fuel injection valve 44. Thus, the fuel vapor readily burns. Consequently, the startability of the internal combustion engine 30 can be improved by supplying the fuel vapor as startup fuel. Further, the fuel vapor is a relatively light substance. Therefore, the concentration of hydrocarbon contained in an unburned gas is low.

Unlike the concentration of the fuel vapor discharged from the canister 22, it can be expected that a certain degree of fuel vapor concentration will be constantly attained in the fuel tank 10 during a startup sequence for the internal combustion engine 30. To achieve a proper air-fuel ratio, it is necessary to decrease the amount of fuel injection from the fuel injection valve 44 in accordance with the amount of fuel vapor supply. Since it can be expected that a certain degree of vapor concentration will be constantly attained as mentioned above, it is possible to accurately determine the amount of fuel injection from the fuel injection valve 44.

The amount of fuel injection from the fuel injection valve 44 is determined by fuel injection time TAU, which is the time during which the fuel injection valve 44 is open. The fuel injection time TAU is calculated from Equation 1 below:

$$TAU=TP\times(FW+FAF+KGX-FPG) \quad \text{(Equation 1)}$$

The value TP in Equation 1 represents basic fuel injection time, which is calculated by multiplying the ratio between the engine revolving speed NE and intake air mount GA (GA/NE) by a predefined injection coefficient K.

The values FW, FAF, KGX, and FPG are correction coefficients. The value FW is a water temperature correction coefficient, which is set in accordance with the cooling water temperature of the internal combustion engine 30. The value FAF is an air-fuel ratio feedback coefficient. If the exhaust air-fuel ratio detected in accordance with the output of the oxygen concentration sensor 48 is rich, a small FAF setting is employed to decrease the fuel injection time TAU. If, on the other hand, the exhaust air-fuel ratio is lean, a great FAF setting is employed to increase the fuel injection time TAU. The value KGX is a learning value for compensating for an air-fuel ratio deviation due, for instance, to aging. It is set variously for all operating regions, which are classified according to the engine revolving speed and engine load. The value FPG is a purge correction coefficient, which reduces the fuel injection amount for correction purposes depending on the amount of fuel vapor (purge gas) supply.

Figure 3:
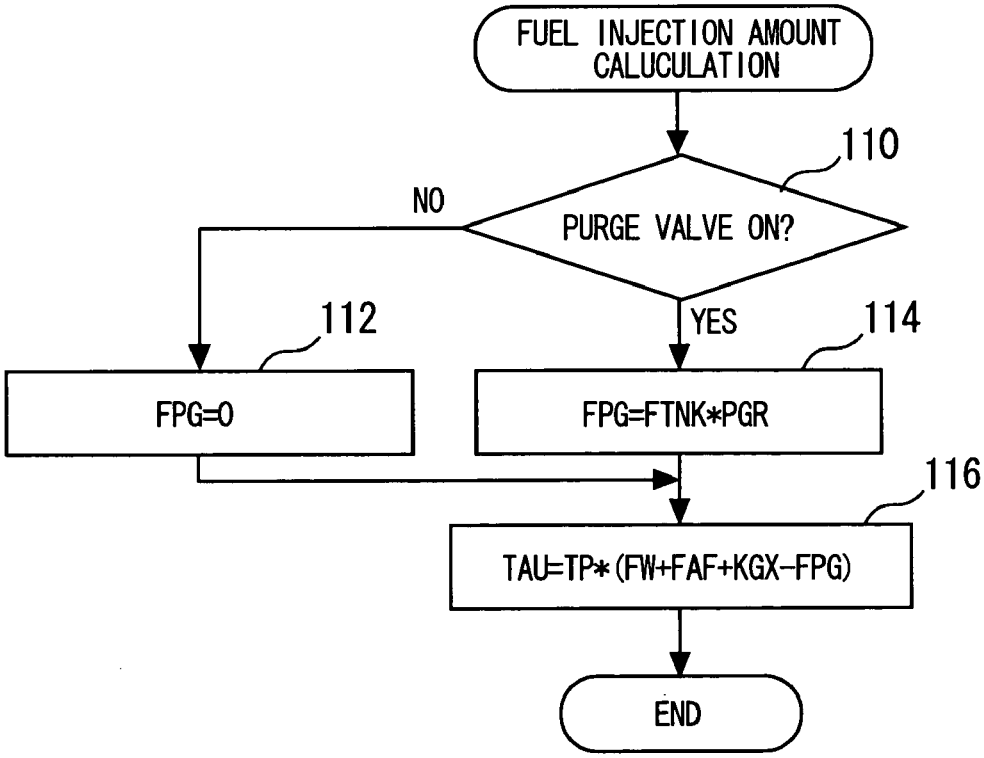
FIG. 3 is a flowchart illustrating a cumulative fuel injection time calculation routine that is executed in the first embodiment of the present invention.

The ECU 50, which serves as a controller for the evaporative fuel treatment apparatus, calculates the above-mentioned fuel injection time TAU in accordance with a routine indicated in the flowchart in FIG. 3. In the routine shown in FIG. 3, step 110 is first performed to check whether the purge valve 28 is open.

If it is found in step 110 that the purge valve 28 is not open, the purge correction coefficient FPG is set to zero because the fuel vapor is not supplied to the internal combustion engine (step 112).

If, on the other hand, it is found in step 110 that the purge valve 28 is open, the purge correction coefficient FPG is set to a value that is calculated by Equation 2 below (step 114):

$$FPG=FTNK\times PGR \quad \text{(Equation 2)}$$

The value FTNK in Equation 2 above is a coefficient that is determined according to the vapor concentration in the fuel tank 10. The vapor concentration in the fuel tank 10 is stable. Further, it can be expected that a certain degree of vapor concentration will be constantly attained. Therefore, the vapor concentration coefficient FTNK is fixed at a representative value that corresponds to a vapor concentration at normally estimated pressure/temperature.

The value PGR in Equation 2 above is a current purge rate. The purge rate PGR is a percentage value that indicates a ratio between the intake air amount GA and the amount of a purge gas flow QPG through the purge valve 28 (QPG/GA). The purge flow amount QPG can be determined by applying a well-known method in accordance with intake pressure PM and the drive duty ratio of the purge valve 28. The intake pressure PM can be estimated by applying a well-known method in accordance with the intake air amount GA and the like. The purge rate PGR is set on the assumption that the purge valve 28 is fully open, that is, the drive duty ratio is 100%.

The routine shown in FIG. 3 uses Equation 1 above to calculate the fuel injection time TAU in accordance with the purge correction coefficient FPG, which is set in step 112 or 114 (step 116). The fuel injection time TAU is then decreased for correction purposes in accordance with the amount of fuel vapor supply from the fuel tank 10 to the internal combustion engine 30.

When the fuel vapor is to be supplied from the fuel tank 10 to the internal combustion engine 30 at internal combustion engine startup, the fuel injection time calculation routine, which is described above, can correct the fuel injection time TAU in accordance wit the amount of such fuel vapor supply. Since it can be expected that a certain degree of fuel vapor concentration is constantly attained in the fuel tank 10, the difference between the above-mentioned representative value and actual value is small so that the fuel injection time TAU calculated using the above-mentioned representative value does not significantly deviate from a proper value. Therefore, the evaporative fuel treatment apparatus according to the present embodiment can select an appropriate setting for the amount of fuel injection from the fuel injection valve 44 while supplying evaporative fuel of a certain concentration from the fuel tank 10 during internal combustion engine startup during which combustion is unstable. This makes it possible to obtain excellent combustion stability from the startup sequence.

In the first embodiment described above, "evaporative fuel supply means" is implemented by the vapor path 20, the purge valve 28, and the ECU 50, which executes the routine shown in FIG. 2.

The first embodiment described above does not specifically stipulate the time for terminating the fuel vapor supply from the fuel tank 10, that is, the time for closing the purge valve 28. The time for closing the purge valve 28 will be explained when a subsequent embodiment is described. Alternatively, however, an appropriate purge valve opening time setting (e.g., 20 sec) may be selected so as to close the purge valve 28 when the associated timer count value reaches the purge valve opening time setting.

In the first embodiment described above, the vapor concentration coefficient FTNK is fixed at a representative value. Alternatively, however, the vapor concentration coefficient FTNK may be set to a value that corresponds to measured values of the internal pressure and temperature in the fuel tank 10.

Second Embodiment

A second embodiment of the present invention will now be described with reference to FIGS. 4A through 6.

Figure 4A:
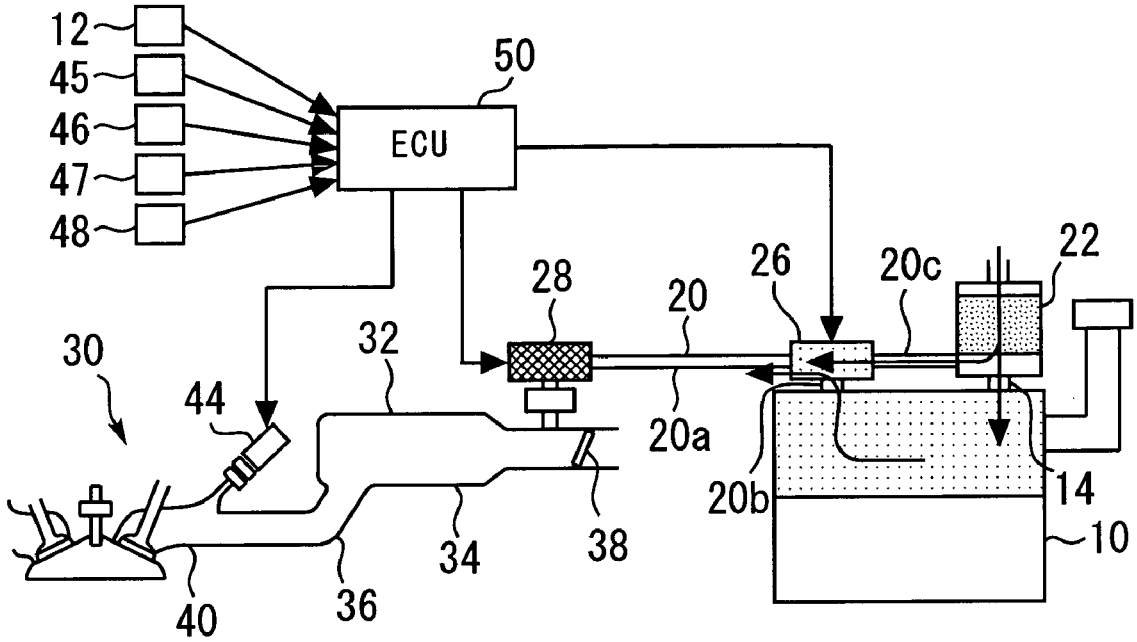
FIG. 4A illustrates the configuration of a second embodiment of an evaporative fuel treatment apparatus according to the present invention.

FIG. 4A outlines the second embodiment of an evaporative fuel treatment apparatus according to the present invention. Elements that are shown in FIG. 4A and identical with the counterparts described in conjunction with the first embodiment are assigned the same reference numerals as their counterparts and will not be described again.

As indicated in FIG. 4A, the present embodiment differs from the first embodiment in the flow path for the fuel vapor discharged from the canister 22. As is the case with the first embodiment, the canister 22 is connected to the atmospheric air introduction hole 14 in the fuel tank 10 and directly connected to the vapor path 20. In the present embodiment, the vapor path 20 comprises a main line 20*a*, a tank line 20*b*, and a canister line 20*c*. The tank line 20*b* and canister line 20*c* branch off from the main line 20*a*. The main line 20*a* is connected to the intake path 32. The tank line 20*b* is connected to the fuel tank 10. The canister line 20*c* is connected to the canister 22. In the present embodiment, therefore, the single main line 20*a* is shared so that the fuel vapor in the fuel tank 10 and the fuel vapor discharged from the canister 22 are both supplied directly to the intake path 32.

A changeover valve 26 is provided at a branch between the main line 20*a* in the vapor path 20 and the tank line 20*b* and canister line 20*c*. The changeover valve 26 selectively connects the tank line 20*b* or canister line 20*c* to the main line 20*a*. Therefore, either the tank line 20*b* or canister line 20*c* is connected to the main line 20*a* in accordance with the operation of the changeover valve 26. When the canister line 20*c* is connected to the main line 20*a*, it is assumed that the changeover valve 26 is ON. When the tank line 20*b* is connected to the main line 20*a*, it is assumed that the changeover valve 26 is OFF. The present embodiment assumes that the basic state of the changeover valve 26 is OFF. In accordance with a drive signal supplied from the ECU 50, the changeover valve 26 changes the connection state of the vapor path 20.

If the changeover valve 26 is OFF, the fuel tank 10 is connected to the intake path 32 so that the fuel vapor in the fuel tank 10 is supplied to the intake path 32. In this instance, the fuel vapor discharged from the canister 22 is supplied to the fuel tank 10 via the atmospheric air introduction hole 14. If, on the other hand, the changeover valve 26 is ON, the canister 22 is connected to the intake path 32 so that the fuel vapor discharged from the canister 22 is directly supplied to the intake path 32.

In the present embodiment, the ECU 50, which serves as a controller for the evaporative fuel treatment apparatus, supplies drive signals to the purge valve 28, fuel injection valve 44, and changeover valve 26. The control operation that the ECU 50 performs for the purge valve 28 and changeover valve 26 will now be described with reference to a flowchart shown in FIG. 5. The control operation that the ECU 50 performs for the fuel injection valve 44 will also be described with reference to a flowchart in FIG. 6. Parameters identical with the counterparts described in conjunction with the first embodiment are assigned the same reference numerals as their counterparts and will not be described again.

Figure 5:
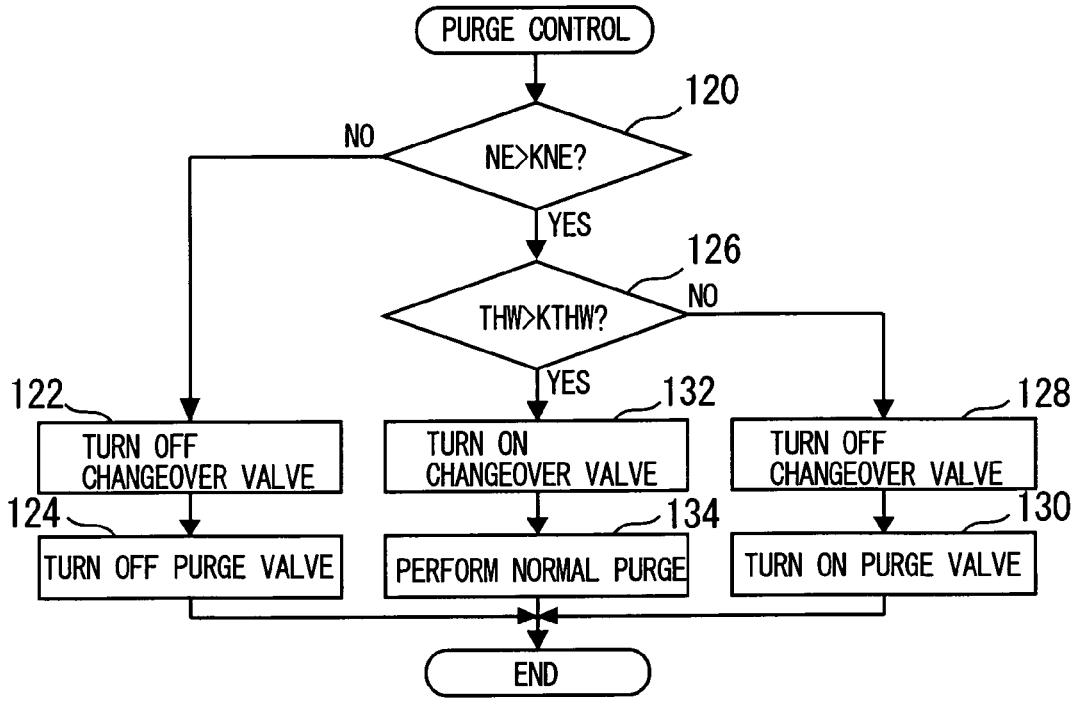
FIG. 5 is a flowchart illustrating a purge control routine that is executed in the second embodiment of the present invention.

FIG. 5 is a flowchart illustrating a purge control operation that is performed by the ECU 50, which serves as a controller for the present embodiment of an evaporative fuel treatment apparatus. In a routine shown in FIG. 5, the engine revolving speed NE is detected in accordance with the output from the revolving speed sensor 46 and compared against a predetermined judgment value KNE (step 120).

If it is found in step 120 that the engine revolving speed NE is not greater than the judgment value KNE, the changeover valve 26 is maintained in the basic state, that is, the OFF state (step 122). Further, the purge valve 28 remains closed (step 124).

If, on the other hand, it is found that the judgment value KNE is exceeded by the engine revolving speed NE, the cooling water temperature THW of the internal combustion engine is detected in accordance with the output from the cooling water temperature sensor 47 and compared against a predetermined judgment value KTHW (step 126). The judgment value KTHW is used as reference value for judging whether the current startup is a cold start. The judgment value KTHW should be set, for instance, to the lowest cooling water temperature for permitting the internal combustion engine 30 to maintain its stable idling state. The definite value can be properly determined in accordance with the results of experiments.

If the comparison result indicates that the cooling water temperature THW is not greater than the judgment value KTHW, the changeover valve 26 is maintained in the basic state, that is, the OFF state (step 128). In this instance, the purge valve 28 fully opens (step 130). Since the purge valve 28 opens while the changeover valve 26 is OFF, the fuel tank 10 communicates with the intake path 32. The fuel vapor in the fuel tank 10 is then supplied to the internal combustion engine 30.

If the judgment value KTHW is exceeded by the cooling water temperature THW, the changeover valve 26 turns ON so that the canister 22 communicates with the intake path 32 (step 132). In this instance, the control operation for the purge valve 28 switches from a startup control mode in which the drive duty ratio is 100% to a normal purge control mode (step 134). In the normal purge control mode, a target purge rate is set in accordance with the operating state of the internal combustion engine 30, and the drive duty ratio for the purge valve 28 is set so that the purge rate PGR coincides with the target purge rate setting. This normal purge control operation will not be described in detail herein because it is well known.

If the internal combustion engine 30 is already warmed up in a situation where, for instance, internal combustion engine 30 is restarted immediately after its stop, the purge control routine described above immediately starts the normal purge control operation so that the purge gas from the canister 22 is supplied to the internal combustion engine 30. Concentrated fuel vapor in the fuel tank 10 is supplied to the internal combustion engine 30 only when the internal combustion engine 30 is cold started. After the internal combustion engine 30 is warmed up, the source for supplying the fuel vapor to the internal combustion engine 30 changes from the fuel tank 10 to the canister 22. Since the concentration of the fuel vapor discharged from the canister 22 by means of a purge is not known, a large amount of fuel vapor cannot be supplied until concentration learning is completed. If the amount of adsorbed fuel vapor is small, it is impossible to supply concentrated fuel vapor. After the internal combustion engine is warmed up, however, satisfactory combustion is achieved with the fuel injected from the fuel injection valve 44 and without resorting to the fuel vapor supply. The purge control routine according to the present embodiment supplies the fuel vapor of steady concentration in the fuel tank 10 only when the internal combustion engine is cold started while the catalytic device is inactive. As the fuel vapor in the fuel tank 10 is supplied only when the internal combustion engine is cold started, it is possible to prevent the fuel vapor in the fuel tank 10 from being wasted and expended.

The interior of the fuel tank 10 is maintained substantially at atmospheric pressure, whereas the interior of the intake path 32 is maintained at negative pressure. Therefore, when the canister 22 is directly connected to the intake path 32 after the internal combustion engine 30 is warmed up, the fuel vapor adsorbed by the canister 22 is efficiently purged from the canister. In other words, the evaporative fuel treatment apparatus according to the present embodiment enhances the purge efficiency of the canister 22 to obtain higher adsorptive power from the canister than the first embodiment.

In the present embodiment, the ECU 50, which serves as a controller for the evaporative fuel treatment apparatus, calculates the fuel injection time TAU. This calculation process is performed by a routine shown in FIG. 6 in correspondence with the above-mentioned purge control routine. In the routine shown in FIG. 6, step 140 is first performed to judge whether the purge valve 28 is currently open.

If it is found that the purge valve 28 is not open, the fuel vapor is not supplied to the internal combustion engine 30. Therefore, the purge correction coefficient FPG in Equation 1 above is set to zero (step 142).

If it is found in step 140 that the purge valve 28 is open, step 144 is performed to determine whether the changeover valve 26 is ON or OFF, that is, whether the fuel tank 10 or canister 22 is connected to the intake path 32.

If it is found in step 144 that the changeover valve is OFF with the fuel tank 10 connected to the intake path 32, the purge correction coefficient FPG is set to a value that is determined by Equation 2 above (step 146).

If, on the other hand, it is found in step 144 that the changeover valve is ON with the canister 22 connected to the intake path 32, the purge correction coefficient FPG is set to a value that is determined by Equation 3 below (step 148):

$$FPG=FGPG\times PGR \quad \text{(Equation 3)}$$

The value FGPG in Equation 3 above is a vapor concentration learning coefficient, which represents a vapor concentration learning value for the fuel vapor discharged from the canister 22. While normal purge control is exercised, the vapor concentration learning coefficient FGPG is updated as needed so that the oscillation center of the air-fuel ratio feedback coefficient FAF approaches its reference value. If, for instance, the oscillation center of the air-fuel ratio feedback coefficient FAF is displaced toward the rich side while purge control is exercised, the vapor concentration learning coefficient FGPG is updated to a greater value so that the exhaust air-fuel ratio changes toward the lean side.

As the initial value for the vapor concentration learning coefficient FGPG for the current startup, the vapor concentration learning coefficient FGPG for the last shutdown is used. The vapor is adsorbed by and desorbed from the canister 22 even when the vapor concentration learning coefficient FGPG is not being learned at shutdown or after startup. Therefore, the vapor concentration learning coefficient FGPG might greatly deviate from the actual value immediately after changeover valve ON/OFF. However, the routine shown in FIG. 6 is repeated so that the vapor concentration learning coefficient FGPG is updated until it matches the actual value.

Figure 6:
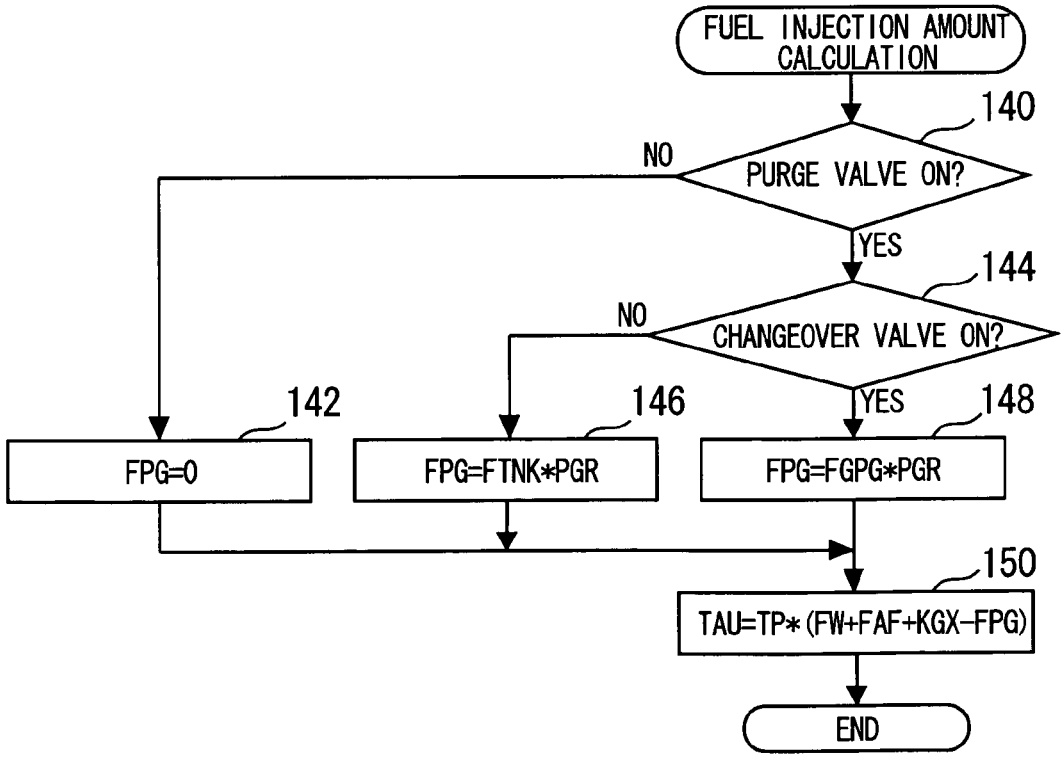
FIG. 6 is a flowchart illustrating a cumulative fuel injection time calculation routine that is executed in the second embodiment of the present invention.

In the routine shown in FIG. 6, the fuel injection time TAU is calculated from Equation 1 above in accordance with the vapor concentration learning coefficient FGPG, which is set in step 142, 146, or 148 (step 150). The fuel injection time TAU is then decreased for correction purposes depending on the amount of fuel vapor supplied from the fuel tank 10 or canister 22 to the internal combustion engine 30.

If the fuel vapor is supplied from the fuel tank 10 to the internal combustion engine 30 at startup, the fuel injection time calculation routine described above can correct the fuel injection time TAU in accordance with the amount of such fuel vapor supply. After the internal combustion engine 30 is warmed up and the changeover valve 26 is operated to connect the canister 22 to the intake path 32 instead of the fuel tank 10, the fuel injection time TAU can be corrected in accordance with the amount of fuel vapor discharged from the canister 22. When the internal combustion engine 30 cold starts during which combustion is unstable, the evaporative fuel treatment apparatus can therefore set an appropriate value for the amount of fuel injection from the fuel injection valve 44 while supplying evaporative fuel of a certain concentration from the fuel tank 10. This makes it possible to obtain satisfactory combustion stability from the startup sequence. Further, the vapor concentration learning coefficient FGPG can be learned to set an appropriate value for the amount of fuel injection from the fuel injection valve 44 after the internal combustion engine 30 is sufficiently warmed up, thereby making it possible to maintain satisfactory combustion stability.

Figure 4B:
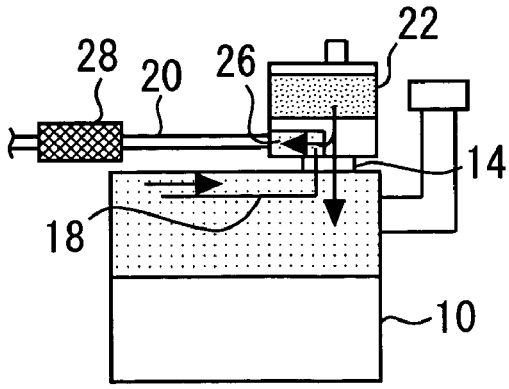
FIG. 4B illustrates a typical modification of the evaporative fuel treatment apparatus shown in FIG. 4A.

The evaporative fuel treatment apparatus according to the present embodiment is not limited to the configuration shown in FIG. 4A. Alternatively, it may be configured as shown in FIG. 4B. Like elements in FIGS. 4A and 4B are identified by the same reference numerals. The configuration shown in FIG. 4B is characterized by the fact that the changeover valve 26 is positioned inside the canister 22. In this configuration, the canister line 20*c*, which is shown in FIG. 4A, is eliminated so that the fuel vapor discharged from the canister 22 directly enters the changeover valve 26. Further, a path 18 for interconnecting the changeover valve 26 and fuel tank 10 is provided for the atmospheric air introduction hole 14 in the fuel tank 10 to which the canister 22 is connected. This path 18 corresponds to the tank line 20*b*, which is shown in FIG. 4A. The evaporative fuel treatment apparatus configured in this manner reduces the number of joints that are exposed to the outside. This minimizes the area for exposing the fuel vapor to atmospheric air, thereby reducing the possibility for allowing the fuel vapor to mix with atmospheric air.

In the second embodiment described above, "evaporative fuel supply means" is implemented by the vapor path 20, the purge valve 28, the changeover valve 26, and the ECU 50, which executes the routine shown in FIG. 5.

Third Embodiment

A third embodiment of the present invention will now be described with reference to FIG. 7.

Figure 7:
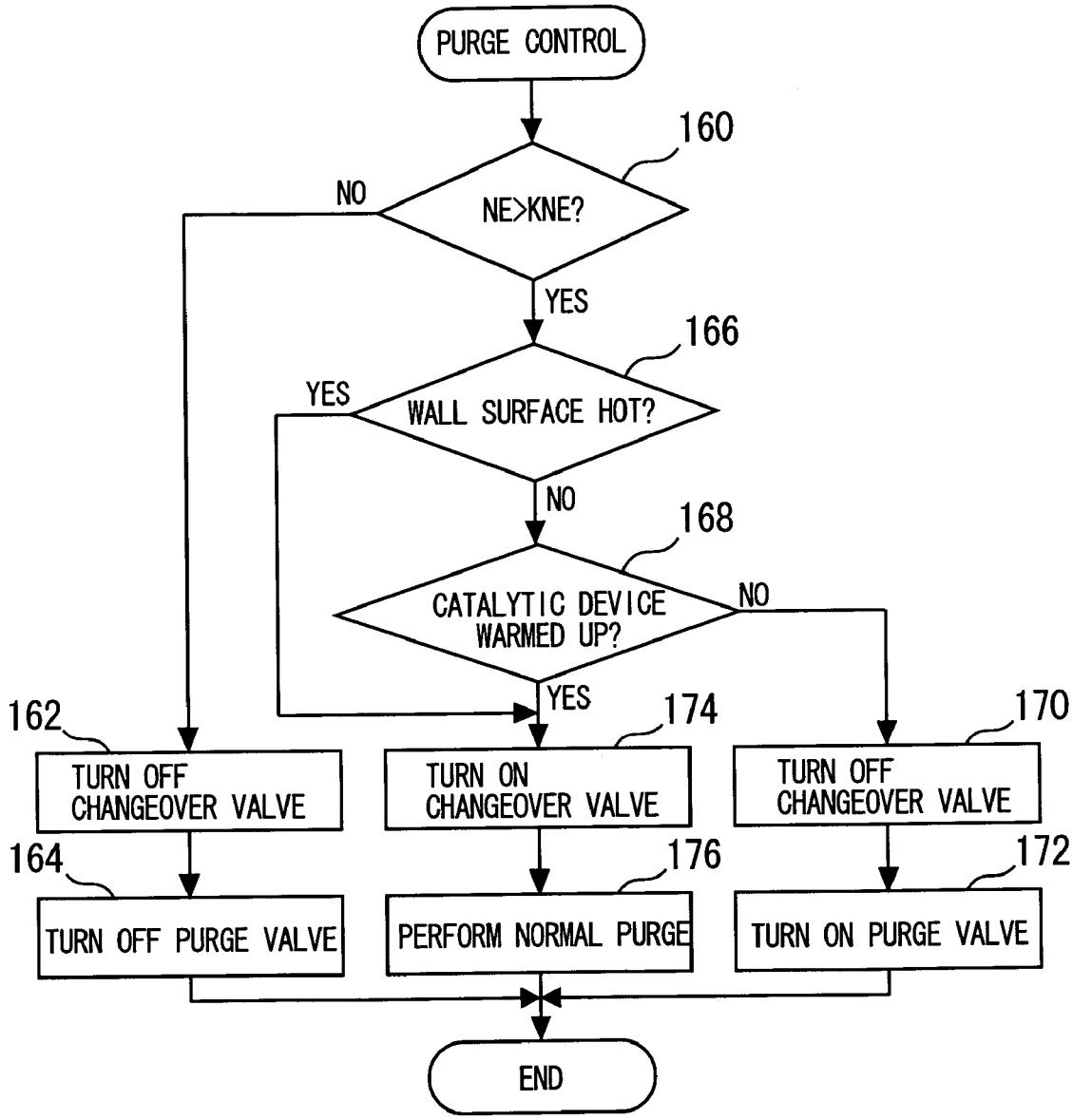
FIG. 7 is a flowchart illustrating a purge control routine that is executed in a third embodiment of the present invention.

An evaporative fuel treatment apparatus according to the present invention is implemented when the second embodiment causes the ECU 50 to execute a routine shown in FIG. 7 instead of the routine shown in FIG. 5.

In the above-mentioned second embodiment, the cooling water temperature THW is detected and compared against the judgment value KTHW. The cooling water temperature THW is detected in order to indirectly judge whether the wall surface temperature of the internal combustion engine 30, particularly, the wall surface temperature of the intake port 40 for fuel injection, is raised to incur fuel evaporation. When the wall surface temperature of the internal combustion engine 30 is sufficiently high, satisfactory combustion is achieved with injected fuel. Therefore, the possibility of unburned hydrocarbon generation can be reduced without supplying the fuel vapor in the fuel tank 10. Meanwhile, when a catalytic device positioned in the exhaust path is warmed up to become active, unburned hydrocarbon can be purified even if it is generated due to improper combustion. Under these circumstances, the present embodiment formulates a purge control judgment by not only checking whether the wall surface temperature is high but also checking whether the catalytic device is warmed up. The wall surface temperature can be estimated not only from the cooling water temperature THW but also from the operating state record concerning the internal combustion engine 30 (engine revolving speed, engine load, etc.). The catalyst temperature can be estimated from the total amount of exhaust gas flow into the catalytic device after the startup of the internal combustion engine 30. The total amount of exhaust gas is substantially equal to the total amount of intake air. Therefore, the catalyst temperature can be estimated by calculating the total amount of air that has been taken in since startup.

FIG. 7 is a flowchart illustrating a purge control operation that is performed by the ECU 50, which serves as a controller for the present embodiment of an evaporative fuel treatment apparatus. In a routine shown in FIG. 7, the engine revolving speed NE is detected in accordance with the output from the revolving speed sensor 46 and compared against a predetermined judgment value KNE (step 160).

If it is found in step 160 that the engine revolving speed NE is not greater than the judgment value KNE, the changeover valve 26 is maintained in the basic state, that is, the OFF state (step 162). Further, the purge valve 28 remains closed (step 164).

If, on the other hand, it is found that the judgment value KNE is exceeded by the engine revolving speed NE, step 166 is performed to judge whether the wall surface is sufficiently heated, that is, whether a predetermined judgment value is exceeded by the wall surface temperature. The wall surface temperature is a value that is estimated from the cooling water temperature THW and the operating state of the internal combustion engine 30 as described earlier. If the judgment result indicates that the wall surface is sufficiently heated, the changeover valve 26 turns ON so that the canister 22 communicates with the intake path 32 (step 174). In this instance, the control of the purge valve 28 changes from a startup control mode, in which the drive duty ratio is 100%, to a normal purge control mode (step 176).

If the judgment result obtained in step 166 indicates that the wall surface is not sufficiently heated, step 168 is performed to judge whether the catalytic device is warmed up, that is, whether a predetermined judgment value is exceeded by the catalyst temperature. As described earlier, the catalyst temperature is a value that is estimated from the intake air amount. If the judgment result indicates that the catalytic device is warmed up, the changeover valve 26 turns ON to let the canister 22 communicate with the intake path 32 no matter whether the wall surface is sufficiently heated (step 174). In this instance, the control of the purge valve 28 changes from a startup control mode, in which the drive duty ratio is 100%, to a normal purge control mode (step 176).

If, on the other hand, the judgment results obtained in steps 166 and 168 indicate that the wall surface is not sufficiently heated and that the catalytic device is not warmed up, the changeover valve 26 is maintained in the basic state, that is, the OFF state (step 170). In this instance, the purge valve 28 fully opens (step 172).

The purge control routine described above changes the source for supplying fuel vapor to the internal combustion engine 30 from the fuel tank 10 to the canister 22 not only when the wall surface temperature is raised so as to vaporize the fuel injected from the fuel injection valve 44 but also when the catalytic device is warmed up to the extent that unburned hydrocarbon can be purified no matter whether the wall surface temperature is raised. In other words, the fuel vapor is supplied from the fuel tank 10 only when unburned hydrocarbon can be discharged to mix with atmospheric air. Therefore, the evaporative fuel treatment apparatus according to the present embodiment can effectively use the fuel vapor in the fuel tank 10 without wasting it.

In the third embodiment described above, "evaporative fuel supply means" is implemented by the vapor path 20, the purge valve 28, the changeover valve 26, and the ECU 50, which executes the routine shown in FIG. 7.

Fourth Embodiment

A fourth embodiment of the present invention will now be described with reference to FIGS. 8 and 9.

Figure 8:
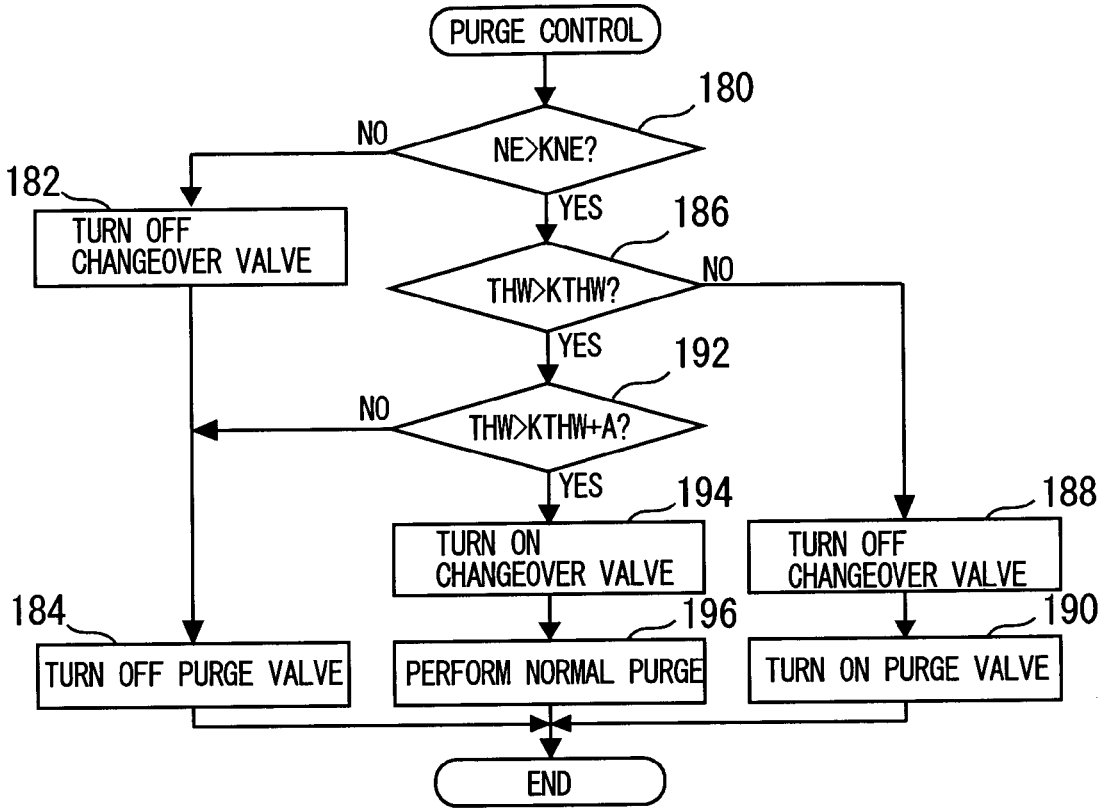
FIG. 8 is a flowchart illustrating a purge control routine that is executed in a fourth embodiment of the present invention.
Figure 9:
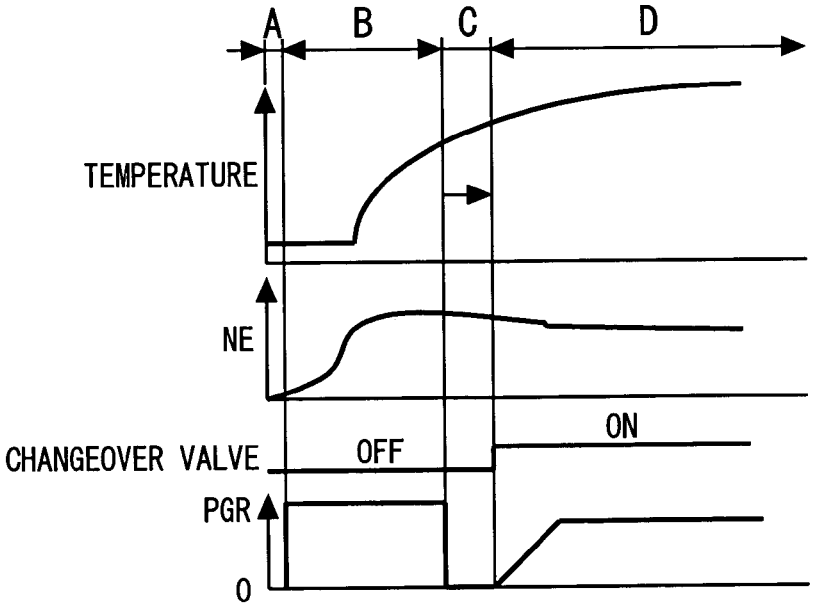
FIG. 9 illustrates changeover valve ON/OFF timing and purge rate changes with time that are provided by the purge control routine shown in FIG. 8.

An evaporative fuel treatment apparatus according to the present invention is implemented when the second embodiment causes the ECU 50 to execute a routine shown in FIG. 8 instead of the routine shown in FIG. 5.

In the second embodiment described earlier, the source for supplying fuel vapor to the internal combustion engine 30 changes from the fuel tank 10 to the canister 22 to start a normal vapor control operation when the cooling water temperature THW exceeds the judgment value KTHW.

However, concentrated fuel vapor, which is supplied from the fuel tank 10, remains in the surge tank 34 for some time after the ON/OFF status of the changeover valve 26 is changed. As a result, the fuel vapor from the fuel tank 10 and the fuel vapor from the canister 22 coexist within the surge tank 34. Therefore, the vapor concentration suddenly changes at the boundary between the two types of fuel vapor. Air-fuel ratio feedback control is exercised while learning the vapor concentration with the vapor concentration learning coefficient FGPG. However, if the vapor concentration suddenly changes, feedback may not be completed in time so that the air-fuel ratio is significantly disordered. Therefore, the present embodiment exercises purge control by executing the routine shown in FIG. 8, thereby preventing the air-fuel ratio from being disordered by the above-mentioned fuel vapor supply source changeover.

FIG. 8 is a flowchart illustrating a purge control operation that is performed by the ECU 50, which serves as a controller for the present embodiment of an evaporative fuel treatment apparatus. In the routine shown in FIG. 8, the engine revolving speed NE is detected in accordance with the output from the revolving speed sensor 46 and compared against a judgment value KNE (step 180).

If the result of comparison indicates that the engine revolving speed NE is not greater than the judgment value KNE, the changeover valve 26 is maintained in the basic state, that is, the OFF state (step 182). In this instance, the purge valve 28 remains closed (step 184). FIG. 9 illustrates changeover valve ON/OFF status changes and purge rate changes occurring upon the execution of the routine shown in FIG. 8 in relation to cooling water temperature and engine revolving speed changes with time. Interval A in FIG. 9 shows the states that prevail before the judgment condition for step 180 is established.

If the engine revolving speed NE exceeds the judgment value KNE, the cooling water temperature THW of the internal combustion engine 30 is detected in accordance with the output from the cooling water sensor 47 and compared against a predetermined first judgment value KTHW (step 186).

If the result of comparison indicates that the cooling water temperature THW is not greater than the first judgment value KTHW, the changeover valve 26 is maintained in the basic state, that is, the OFF state (step 188). In this instance, the purge valve 28 fully opens (step 190). Interval B in FIG. 9 shows the changeover valve ON/OFF status and purge rate PGR that prevail between the instant at which the judgment condition for step 180 is established and the instant at which the judgment condition for step 186 is established.

If the cooling water temperature THW exceeds the first judgment value KTHW, the cooling water temperature THW is compared against a predetermined second judgment value KTHW+A (step 192). The second judgment value KTHW+A is greater than the first judgment value KTHW. The purge valve 28 is fully closed before the cooling water temperature THW exceeds the second judgment value KTHW+A (step 184). Interval C in FIG. 9 shows the changeover valve ON/OFF status and purge valve purge rate PGR that prevail between the instant at which the judgment condition for step 190 is established and the instant at which the judgment condition for step 192 is established. When the purge valve 28 fully closes, no more fuel vapor is supplied to the intake path 32 so that the concentrated fuel vapor remaining in the surge tank 34 gradually decreases in amount.

The temperature difference A between the above two judgment values is set while considering the time interval between the instant at which fuel vapor is supplied from the fuel tank 10 to the intake path 32 and the instant at which the fuel vapor is taken into the combustion chamber of the internal combustion engine 30, that is, the time interval between the instant at which concentrated fuel vapor is supplied from the fuel tank 10 and the instant at which the amount of concentrated fuel vapor remaining in the surge tank 34 is reduced to zero or sufficiently reduced. Since the temperature difference A is set in consideration of the above time interval, the canister purge operation can be performed without undue delay to maintain the adsorptive power of the canister 22 while preventing the fuel vapor fed from the fuel tank 10 from being contiguous to the fuel vapor discharged from the canister 22.

If the judgment result obtained in step 192 indicates that the second judgment value KTHW+A is exceeded by the cooling water temperature THW, the changeover valve 26 turns ON, allowing the canister 22 to communicate with the intake path 32 (step 194). In this instance, normal purge control is exercised for the purge valve 28 (step 196). Interval D in FIG. 9 shows the changeover valve ON/OFF status and purge rate PGR that prevail after the judgment condition for step 192 is established. The concentrated fuel vapor fed from the fuel tank 10 no longer remains or slightly remains in the surge tank 34 after the judgment condition for step 192 is established. Therefore, the vapor concentration does not suddenly change when fuel vapor is supplied from the canister 22. As indicated in interval D, the purge rate PGR gradually increases through learning during air-fuel ratio feedback control. Before long, the purge rate PGR is maintained at a stable value.

The purge control routine described above supplies fuel vapor from the canister 22 to the intake path 32 not immediately after, but a certain period of time after the stop of fuel vapor supply from the fuel tank 10 to the intake path 32. This makes it possible to prevent air-fuel ratio feedback control from being obstructed by a sudden vapor concentration change.

In the fourth embodiment described above, "evaporative fuel supply means" is implemented by the vapor path 20, the purge valve 28, the changeover valve 26, and the ECU 50, which executes the routine shown in FIG. 8. Further, the present embodiment starts supplying fuel vapor from the canister 22 in step 190 when the cooling water temperature THW rises by a predetermined temperature value A after the fuel vapor supply from the fuel tank 10 is stopped. Alternatively, however, the fuel vapor supply from the canister 22 may be started when, for instance, the catalyst temperature rises by a predetermined temperature value, a predetermined period of time elapses, or the purge rate PGR is found to be 0%.

Fifth Embodiment

A fifth embodiment of the present invention will now be described with reference to FIG. 10.

Figure 10:
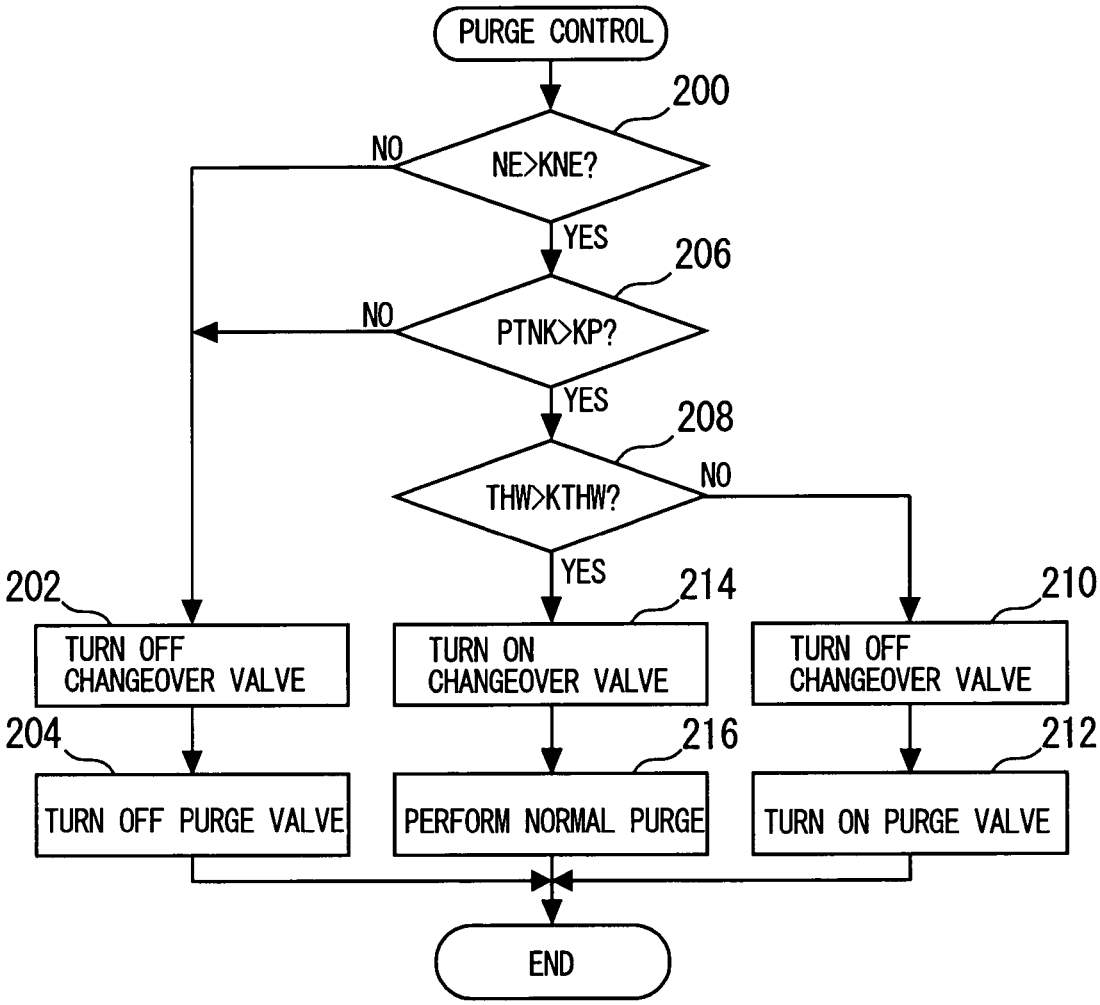
FIG. 10 is a flowchart illustrating a purge control routine that is executed in a fifth embodiment of the present invention.

An evaporative fuel treatment apparatus according to the present invention is implemented when the second embodiment causes the ECU 50 to execute a routine shown in FIG. 10 instead of the routine shown in FIG. 5.

As described earlier, the fuel tank 10 is provided with the atmospheric air introduction hole 14 so that the interior of the fuel tank 10 is maintained substantially at atmospheric pressure. However, the canister 22, which is provided for the atmospheric air introduction hole 14, may become clogged because it contains active carbon. If the canister 22 is clogged, atmospheric air cannot be introduced into the fuel tank 10. Therefore, if the fuel vapor supply from the fuel tank 10 continues, the interior of the fuel tank 10 is placed under negative pressure. Placing the interior of the fuel tank 10 under negative pressure reduces the amount of fuel vapor supply and promotes the vaporization of light fuel constituents. As a result, the properties of the fuel in the tank change or some other inconvenience arises. To prevent the interior of the fuel tank 10 from being placed under negative pressure, the present embodiment executes a purge control routine that is described below.

FIG. 10 is a flowchart illustrating a purge control operation that is performed by the ECU 50, which serves as a controller for the present embodiment of an evaporative fuel treatment apparatus. In the routine shown in FIG. 10, the engine revolving speed NE is detected in accordance with the output from the revolving speed sensor 46 and compared against a judgment value KNE (step 200).

If the result of comparison indicates that the engine revolving speed NE is not greater than the judgment value KNE, the changeover valve 26 is maintained in the basic state, that is, the OFF state (step 202). In this instance, the purge valve 28 remains closed (step 204).

If the engine revolving speed NE exceeds the judgment value KNE, the present embodiment causes the tank internal pressure sensor 12 to detect a tank internal pressure PTNK and compare it against a predetermined judgment value KP (step 206). The judgment value KP is set in consideration of a tank internal pressure prevailing during the use of an unclogged, normal canister 22 and of a critical tank pressure at which the fuel tank 10 breaks.

If it is found in step 206 that the tank internal pressure PTNK is greater than the judgment value KP, processing steps 208 through 216 are performed. Processing steps 208 through 216 are not described herein because they are the same as processing steps 126 through 134 of the second embodiment. If, on the other hand, it is found in step 206 that the tank internal pressure PTNK is not greater than the judgment value KP, the changeover valve 26 remains OFF (step 202). In this instance, the purge valve 28 remains closed (step 204). In other words, the fuel vapor is not supplied from the fuel tank 10 to the intake path 32.

If the tank internal pressure PTNK of the fuel tank 10 lowers due, for instance, to a clogged canister 22, the purge control routine described above stops the fuel vapor supply from the fuel tank 10 to the intake path 32. Thus, the fuel tank 10 will not possibly break because the interior of the fuel tank is prevented from being placed under negative pressure.

In the fifth embodiment described above, the function for stopping the fuel vapor supply from the fuel tank 10 when the tank internal pressure PTNK is low is incorporated in the apparatus according to the second embodiment. However, the apparatus incorporating the above function is not limited to the apparatus according to the second embodiment. More specifically, the above function can be incorporated into the apparatus according to the first, third, or fourth embodiment.

Sixth Embodiment

A sixth embodiment of the present invention will now be described with reference to FIGS. 11 and 12.

Figure 11:
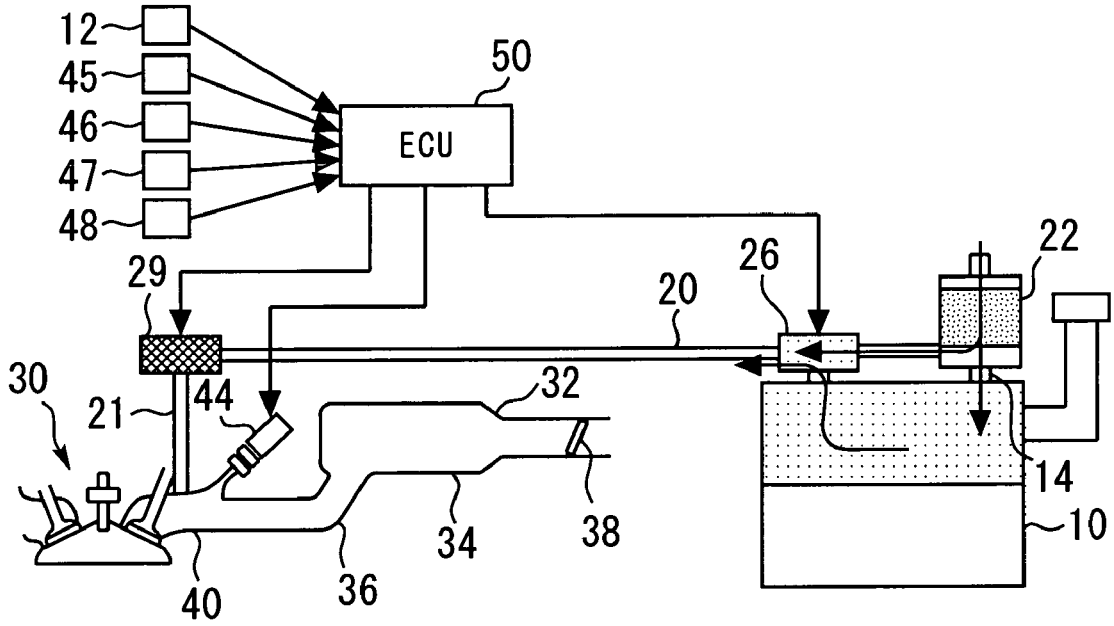
FIG. 11 illustrates the configuration of a sixth embodiment of an evaporative fuel treatment apparatus according to the present invention.
Figure 12:
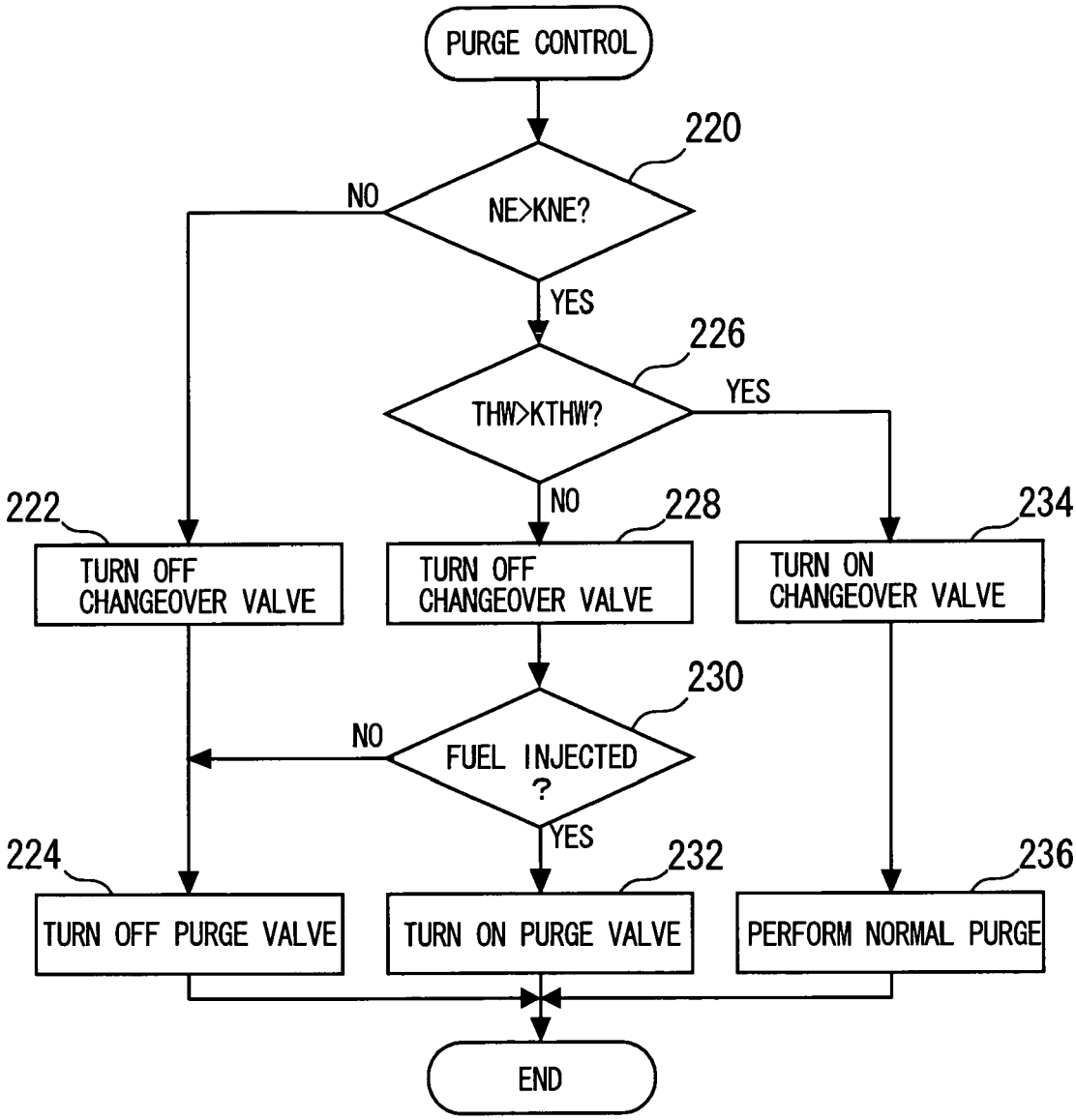
FIG. 12 is a flowchart illustrating a purge control routine that is executed in a sixth embodiment of the present invention.

An evaporative fuel treatment apparatus according to the present invention is implemented when the second embodiment causes the ECU 50 to execute a routine shown in FIG. 12 instead of the routine shown in FIG. 5 while the connection destination for the vapor path 20 is changed from the upstream end of the surge tank 34 to the location shown in FIG. 11. Elements that are shown in FIG. 11 and identical with the counterparts described in conjunction with the second embodiment are assigned the same reference numerals as their counterparts and will not be described again.

As shown in FIG. 11, the leading end of the vapor path 20 is connected to the intake port 40. The vapor path 20 positioned downstream of the purge valve 29 branches to a plurality of branch paths 21, which are connected to the intake port 40 for each cylinder. The purge valve 29 according to the present embodiment is capable of regulating the rate of gas flow in each branch path 21. In the evaporative fuel treatment apparatus according to the present embodiment, therefore, the fuel vapor is supplied on an individual cylinder basis as is the case with the fuel injected from the fuel injection valve 44.

FIG. 12 is a flowchart illustrating a purge control operation that is performed by the ECU 50, which serves as a controller for the present embodiment of an evaporative fuel treatment apparatus. Processing steps 220 through 226, which are shown in FIG. 12, are not described herein because they are the same as processing steps 120 through 126 of the second embodiment.

If the comparison result obtained in step 226 indicates that the cooling water temperature THW is not greater than the judgment value KTHW, the changeover valve 26 is maintained in the basic state, that is, the OFF state (step 228). Before opening the purge valve 29, the present embodiment judges whether a fuel injection operation is performed by the fuel injection valve 44 for each cylinder (step 230). Whether or not the fuel injection operation is performed can be judged by determining whether cylinder identification is achieved. Cylinder identification is achieved by detecting the crank angle. The cylinder identification method based on the crank angle will not be described herein because it is well known. The purge valve 29 remains closed until the fuel injection operation is performed (step 224). After the fuel injection operation, that is, after cylinder identification, the purge valve 29 for each cylinder fully opens. This purge valve opening operation is sequentially performed for all cylinders, beginning with the cylinder for which the fuel injection operation is performed first. As a result, the concentrated fuel vapor in the fuel tank 10 is directly supplied to the intake port 40 (step 232).

If the cooling water temperature THW exceeds the judgment value KTHW, the changeover valve 26 turns ON to let the canister 22 communicate with each intake port 40 (step 234). In this instance, the control of the purge valve 29 changes from a startup control mode, in which the drive duty ratio is 100%, to a normal purge control mode (step 236). This ensures that the fuel vapor discharged from the canister 22 is supplied to each cylinder.

The purge control routine described above starts supplying the fuel vapor after the cylinders are identified to permit fuel injection. Therefore, it is possible to avoid useless fuel vapor supply at an early stage of cranking for the internal combustion engine 30. This not only permits effective use of concentrated fuel vapor in the fuel tank 20, but also prevents unburned hydrocarbon from being discharged upon fuel vapor supply prior to ignition.

In the sixth embodiment described above, the structure for supplying the fuel vapor to each cylinder and the function for supplying the fuel vapor after cylinder identification are incorporated in the apparatus according to the second embodiment. However, the apparatus incorporating the above functionality is not limited to the apparatus according to the second embodiment. More specifically, the above functionality can be incorporated into the apparatus according to the first, third, fourth, or fifth embodiment.

Seventh Embodiment

A seventh embodiment of the present invention will now be described with reference to FIGS. 13 and 14.

Figure 13:
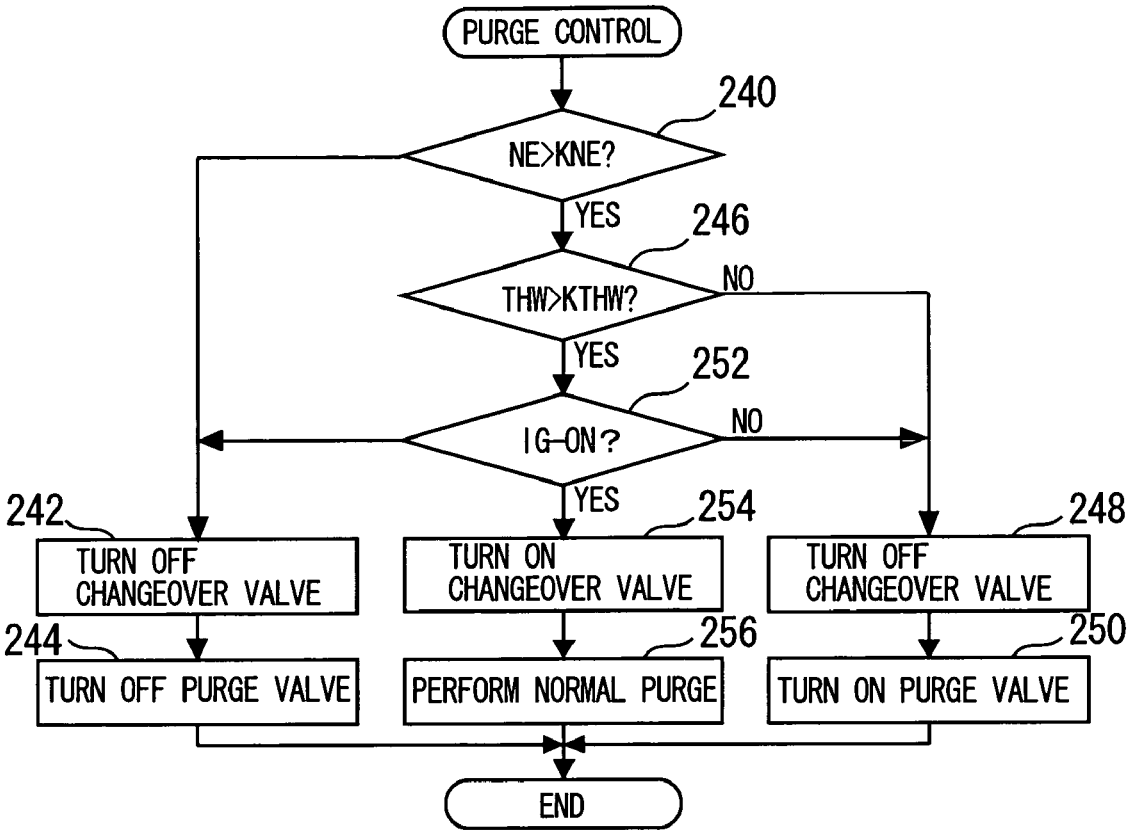
FIG. 13 is a flowchart illustrating a purge control routine that is executed in a seventh embodiment of the present invention.
Figure 14:
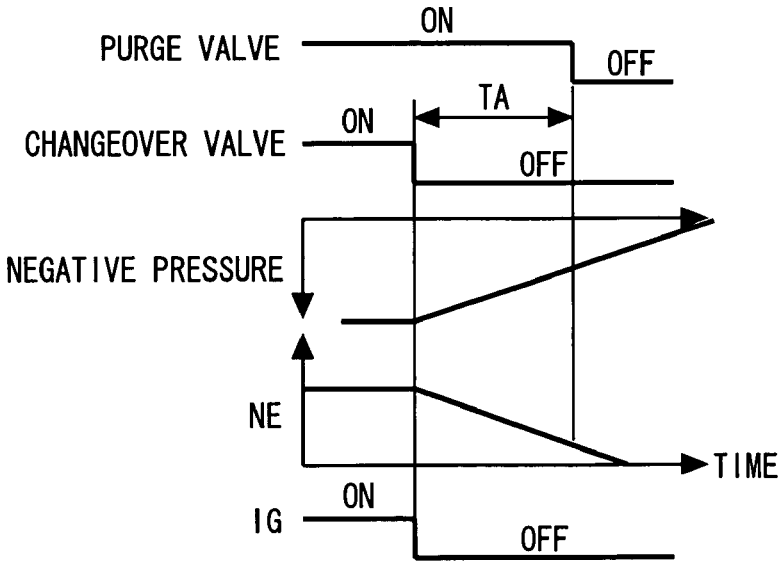
FIG. 14 illustrates changeover valve ON/OFF timing and purge valve ON/OFF timing that are provided by the purge control routine shown in FIG. 13.

An evaporative fuel treatment apparatus according to the present embodiment is implemented when the second embodiment causes the ECU 50 to execute a routine shown in FIG. 13 instead of the routine shown in FIG. 5.

When a running internal combustion engine 30 comes to a stop so that the engine revolving speed NE is below the judgment value KNE, the purge control routine according to the second embodiment, which is shown in FIG. 5, changes the status of the changeover valve 26 from ON to OFF (step 122) and fully closes the purge valve 28 (step 124). The internal combustion engine 30 then comes to a stop while the vapor path 20 communicates with the fuel tank 10. In the next operation, the condition for step 120 is established so that the purge valve 28 fully opens (step 130). As a result, fuel vapor of steady concentration is supplied from the fuel tank 10 to the intake path 32 via the vapor path 20.

Immediately after the condition for step 120 is established to open the purge valve 28, however, the thin fuel vapor discharged from the canister 22 flows into the intake path 32. The reason is that the purge valve 28 closes when the last operation stops while the fuel vapor is being supplied from the canister 22. Thus, the fuel vapor supplied from the canister 22 remains within the vapor path 20. For improvement of the startability of the internal combustion engine 30, concentrated fuel vapor in the fuel tank 10 should be supplied immediately after the purge valve 28 opens. Under these circumstances, the present embodiment adopts the purge control routine shown in FIG. 13 in order to supply concentrated fuel vapor from the fuel tank 10 immediately after the purge valve 28 opens.

FIG. 13 is a flowchart illustrating a purge control operation that is performed by the ECU 50, which serves as a controller for the present embodiment of an evaporative fuel treatment apparatus. The present embodiment exercises purge control, which is characterized by a control operation that is performed when the internal combustion engine 30 is stopped. The control operation to be performed at startup, which is performed by processing steps 240 through 250, is identical with the operation performed by processing steps 120 through 130 of the control routine shown in FIG. 5. The subsequent description mainly deals with control that is peculiar to the present embodiment.

If it is found in step 246 that the cooling water temperature THW exceeds the judgment value KTHW, the purge control routine shown in FIG. 13 judges whether the ignition switch is ON or OFF (step 252). When the ignition switch turns OFF, the ECU 50 stops the fuel injection and sparking operations, thereby bringing the internal combustion engine 30 to a stop. After the fuel injection and sparking operations are stopped, however, the rotary mechanism of the internal combustion engine 30 continues rotating for a while due to its force of inertia. Therefore, the engine revolving speed NE gradually lowers. As a result, the engine revolving speed NE lowers after the ignition switch turns OFF, and there is a time lag before the engine revolving speed NE drops below the judgment value KNE in step 240.

If it is found in step 252 that the ignition switch is still ON, the changeover valve 26 remains ON (step 254), and the purge valve 28 is subject to normal purge control (step 256). In this instance, the fuel vapor discharged from the canister 22 is supplied to the intake path 32.

If, on the other hand, it is found in step 252 that the ignition switch is OFF, the changeover valve 26 turns OFF so that the fuel tank 10 communicates with the vapor path 20 (step 248). In this instance, the purge valve 28 fully opens in the same manner as at startup (step 250). FIG. 14 shows the relationship among the ON/OFF timing of the changeover valve 26 and purge valve 28, the ON/OFF timing of the ignition switch, and the changes with time in the negative pressure in the intake path 32 and the engine revolving speed NE, which prevails when the routine shown in FIG. 13 is executed. As indicated in FIG. 14, if the internal combustion engine 30 continuously rotates after ignition switch OFF, its pumping effect places the interior of the intake path 32 under negative pressure according to the engine revolving speed NE. Therefore, the gas in the vapor path 20 is sucked into the intake path 32. The fuel vapor in the fuel tank 10 is sucked into the vapor path 20 in correspondence with the gas that is sucked into the intake path 32 from the vapor path 20.

When it is found in step 240 that the engine revolving speed NE is further decreased below the judgment value KNE, the purge valve 28 closes (step 242). In the present embodiment, there is a time lag TA, as shown in FIG. 14, between the instant at which the changeover valve 26 turns OFF and the instant at which the purge valve 28 closes. This ensures that the vapor path 20 closes while it is filled with the concentrated fuel vapor supplied from the fuel tank 10.

The purge control routine described above stops the operation of the internal combustion engine 30 while the vapor path 20 is filled with concentrated fuel vapor supplied from the fuel tank 10. Therefore, the next time the internal combustion engines starts up, concentrated fuel vapor can be supplied to the intake path 32 immediately after the purge valve 28 opens. Consequently, the present embodiment of an evaporative fuel treatment apparatus improves the startability of the internal combustion engine 30 to a greater extent than the second embodiment.

In the seventh embodiment described above, "evaporative fuel supply means" is implemented by the vapor path 20, the purge valve 28, the changeover valve 26, and the ECU 50, which executes the routine shown in FIG. 13.

In the seventh embodiment described above, the function for stopping the internal combustion engine 30 while the vapor path 20 is filled with the concentrated fuel vapor supplied from the fuel tank 10 is incorporated in the apparatus according to the second embodiment. However, the apparatus incorporating the above function is not limited to the apparatus according to the second embodiment. More specifically, the above function can be incorporated into the apparatus according to the third, fourth, fifth, or sixth embodiment.

Eighth Embodiment

An eighth embodiment of the present invention will now be described with reference to FIG. 15.

Figure 15:
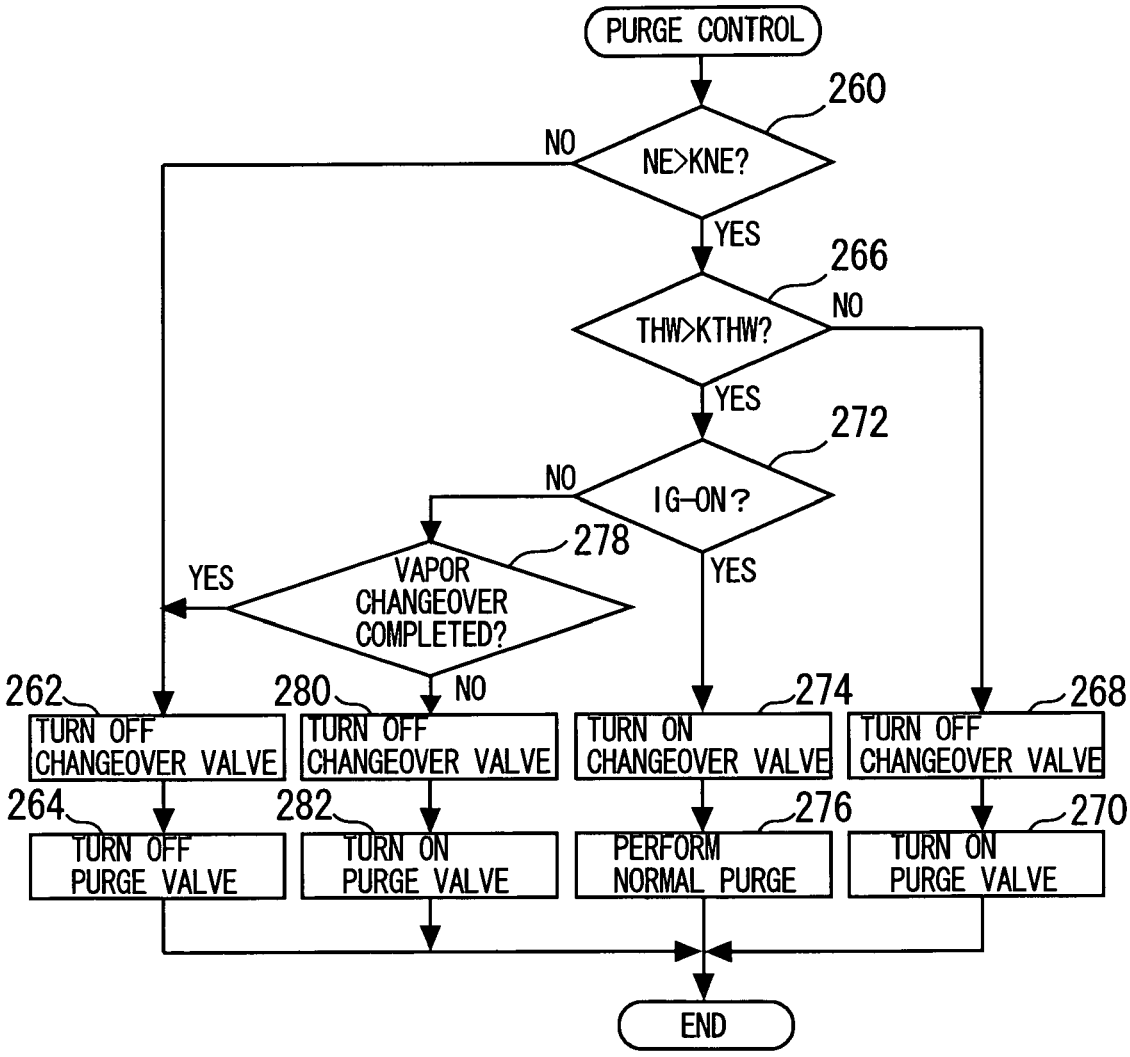
FIG. 15 is a flowchart illustrating a purge control routine that is executed in an eighth embodiment of the present invention.

An evaporative fuel treatment apparatus according to the present invention is implemented when the second embodiment causes the ECU 50 to execute a routine shown in FIG. 15 instead of the routine shown in FIG. 5.

The seventh embodiment described earlier can stop the operation of the internal combustion engine 30 while the vapor path 20 is filled with the concentrated fuel vapor supplied from the fuel tank 10. However, the fuel vapor supplied from the fuel tank 10 may exceed the cubic capacity of the vapor path 20 depending on the relationship between the cubic capacity of the vapor path 20 and the time interval between changeover valve turn-OFF and purge valve closure. Such an excessive amount of fuel vapor, which exceeds the cubic capacity of the vapor path 20, flows into the intake path 32, and remains within the intake path 32 even after the internal combustion engine 30 stops. The next time the internal combustion engine 30 starts up, the fuel vapor remaining in the intake path 32 is first supplied to the internal combustion engine 30. However, the fuel vapor remaining in the intake path 32 differs from the fuel vapor in the vapor path 20 because the former does not have a steady concentration. While the internal combustion engine 30 is stopped so that the temperature is low, the fuel vapor might liquefy in the intake path 32. For stable combustion and satisfactory startability of the internal combustion engine 30, it is necessary to supply fuel vapor of steady concentration. For such purposes, concentrated fuel vapor should not be left in the intake path 32 while the internal combustion engine 30 is stopped. Under these circumstances, the present embodiment adopts a purge control routine shown in FIG. 15 to ensure that no concentrated fuel vapor remains in the intake path 32.

FIG. 15 is a flowchart illustrating a purge control operation that is performed by the ECU 50, which serves as a controller for the present embodiment of an evaporative fuel treatment apparatus. The present embodiment exercises purge control, which is characterized by a control operation that is performed after the ignition switch turns OFF. The control operation to be performed before ignition switch OFF, which is performed by processing steps 260 through 276, is identical with the operation performed by processing steps 240 through 256 of the control routine shown in FIG. 13. The subsequent description mainly deals with control that is peculiar to the present embodiment.

If it is found in step 272 that the ignition switch is OFF, the purge control routine shown in FIG. 15 judges whether the fuel vapor in the vapor path 20 is changed (step 278). More specifically, the purge control routine judges whether the fuel vapor of unsteady concentration, which is discharged from the canister 22, is replaced by concentrated fuel vapor of steady concentration, which is generated in the fuel tank 10. Three typical changeover judgment methods may be used as described below.

A first method is to compare the engine revolving speed NE against a judgment value KNEI (note, however, that KNE<KNEI). If the engine revolving speed NE is below the judgment value KNEI, it is concluded that the fuel vapor in the vapor path 20 is replaced by the fuel vapor supplied from the fuel tank 10. The judgment value KNEI can be determined by experiment.

A second method is to use a timer for counting the time since ignition switch OFF. The timer's counting operation starts when the ignition switch turns OFF. When the count TOFF reached by the counter exceeds a judgment value KTIME, it is concluded that the fuel vapor in the vapor path 20 is replaced by the fuel vapor supplied from the fuel tank 10. The judgment value KTIME can be determined by experiment.

A third method is to determine the total purge flow amount since ignition switch OFF. As described earlier, the purge flow amount can be determined from the intake pressure PM and the drive duty ratio of the purge valve 28 when a known method is applied. When the total value EQPG of the purge flow amount QPG since ignition switch OFF exceeds a predetermined judgment value KQPG, it is concluded that the fuel vapor in the vapor path 20 is replaced by the fuel vapor supplied from the fuel tank 10. The judgment value KQPG can be determined by experiment.

If it is found in step 278 that the fuel vapor changeover is still not completed in the vapor path 10, the changeover valve 26 is OFF (step 280) and the purge valve 28 fully opens (step 282). In this instance, the fuel vapor remaining in the vapor path 20, which has been supplied from the canister 22, is sucked into the intake path 32. Instead, the concentrated fuel vapor in the fuel tank 10 fills the vapor path 20.

If it is found in step 278 that the fuel vapor changeover is completed in the vapor path 20, the changeover valve remains OFF (step 262) and the purge valve 28 closes (step 264). This ensures that the concentrated fuel vapor in the fuel tank 10 does not flow into the intake path 32, and that the vapor path 20 closes while it is filled with the concentrated fuel vapor supplied from the fuel tank 10. When FIG. 14 is used for explanation purposes, the present embodiment is set so that the time lag TA between the instant at which the changeover valve 26 turns OFF and the instant at which the purge valve 28 closes is equivalent to the time required for fuel vapor changeover in the vapor path 20 and the time during which the fuel vapor does not flow into the intake path 32.

The purge control routine described above not only provides the advantages of the seventh embodiment, but also prevents the concentrated fuel vapor in the fuel tank 10 from flowing into the intake path 32. Therefore, the next time the internal combustion engine 30 starts up, fuel vapor of steady concentration can be supplied to the intake path 32. The fuel vapor supplied from the canister 22 remains in the intake path 32. However, the fuel vapor contained in a purge gas discharged from the canister 22 is of considerably lower concentration than the fuel vapor in the fuel tank 10. Therefore, such remaining fuel vapor exerts an insignificant influence upon the combustibility of the internal combustion engine 30. Consequently, the present embodiment of an evaporative fuel treatment apparatus provides better startability of the internal combustion engine 30 than the seventh embodiment.

In the eighth embodiment described above, "connection change means" is implemented by the main line 20*a*, tank line 20*b*, canister line 20*c*, and changeover valve 26. Further, "evaporative fuel supply means" is implemented by the above "connection change means", the purge valve 28, and the ECU 50, which executes the routine shown in FIG. 13.

In the eighth embodiment described above, the function for closing the purge valve 28 upon completion of fuel vapor changeover in the vapor path 20 and the function according to the seventh embodiment for stopping the internal combustion engine 30 while the vapor path is filled with the concentrated fuel vapor supplied from the fuel tank 10 are incorporated in the apparatus according to the second embodiment. However, the apparatus incorporating the above functions is not limited to the apparatus according to the second embodiment. More specifically, the above functions can be combined with each other and incorporated into the apparatus according to the third, fourth, fifth, or sixth embodiment.

Ninth Embodiment

Figure 16:
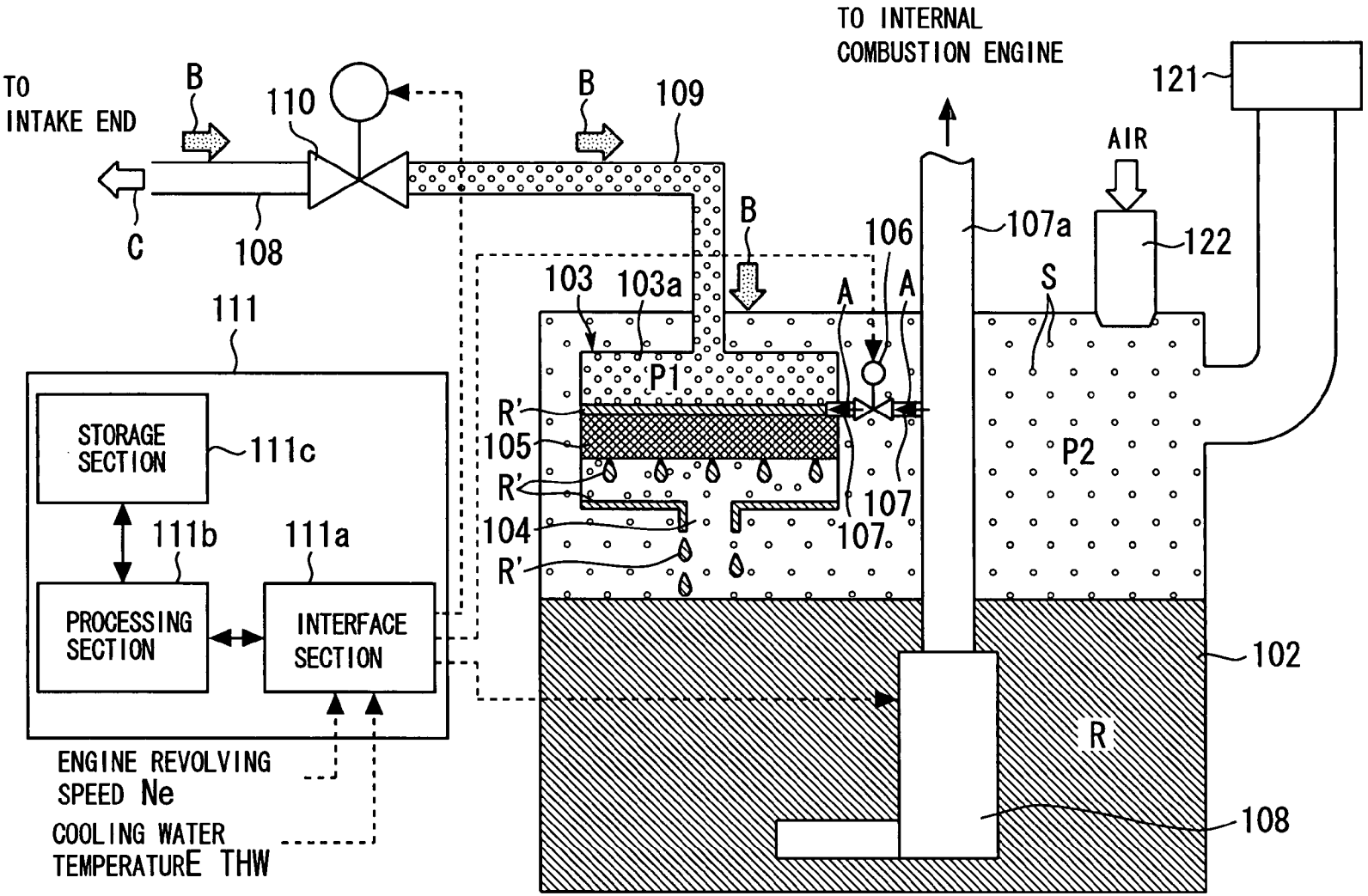
FIG. 16 illustrates the configuration of a ninth embodiment of an evaporative fuel treatment apparatus according to the present invention.
Figure 17:
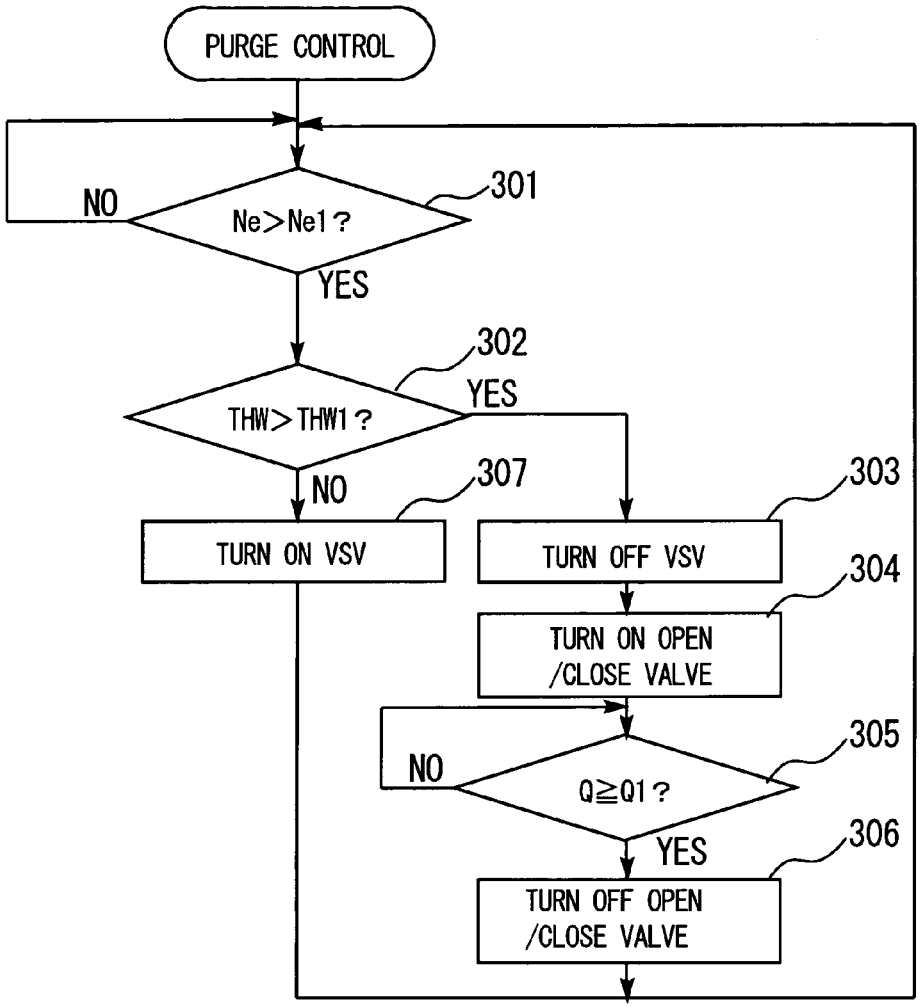
FIG. 17 is a flowchart illustrating a purge control routine that is executed in a ninth embodiment of the present invention.
Figure 18:
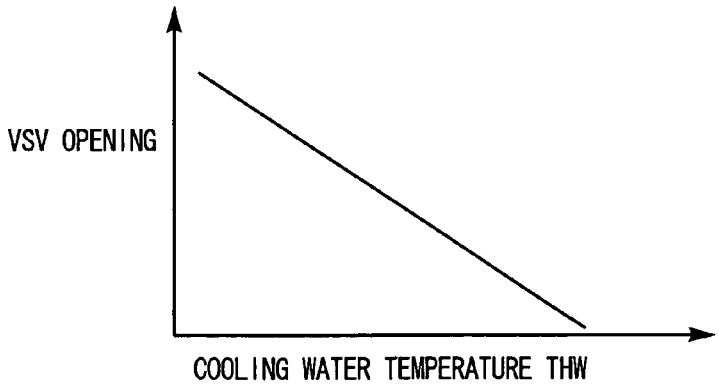
FIG. 18 illustrates a typical map configuration for the VSV opening and cooling water temperature.

A ninth embodiment of the present invention will now be described with reference to FIGS. 16 through 18. FIG. 16 outlines the ninth embodiment of an evaporative fuel treatment apparatus according to the present invention. As indicated in FIG. 16, the evaporative fuel treatment apparatus according to the present embodiment comprises at least a fuel tank 102, an air chamber 103, a porous body 105, a communication hole 104, an open/close valve 106, a fuel supply pipe 107, and a purge valve (VSV) 110. The air chamber 103*a* and porous body 105 constitute a fuel adsorption device. The communication hole 104 is an element of a fuel return device and a gaseous body inflow device. The open/close valve 106 and fuel supply pipe 107 are used to supply liquid fuel R, which is stored in the fuel tank 102, to the inside of the fuel adsorption device.

The air chamber 103 and a fuel pump 108 are positioned in the fuel tank 102. The fuel tank 102 is also provided with an air introduction hole 122. When the pressure within the fuel tank 102 lowers, the air introduction hole 122 introduces air from the outside of the fuel tank 102 to maintain a constant pressure within the fuel tank 102. The air introduction hole 122 also functions so that air, which is a gaseous body in the fuel tank 102, does not go out of the fuel tank 102. Such an additional function of the air introduction hole 122 is exercised to prevent evaporative fuel S, which has mixed with air in the fuel tank 102, from leaking out of the fuel tank 102. Liquid fuel R, which is supplied from a fuel supply hole 121, is a mixture of light fuel, which has a low boiling point, and heavy fuel, which has a high boiling point. The fuel tank 102 is filled with air that is introduced from the air introduction hole 122. The low-boiling-point light fuel, which is contained in the liquid fuel R stored in the fuel tank 102, spontaneously vaporize over the surface of the liquid fuel R. The resulting evaporative fuel, which is now vaporized, mixes with the air in the fuel tank 102 and fills the fuel tank 102 as indicated in the figure.

The air chamber 103, which is an element of the fuel adsorption device, has a spatial section 103*a*. The porous body 105 is provided in the spatial section 103*a* to separate the spatial section 103*a* into upper and lower zones. Liquid fuel R' is supplied to the spatial section 103*a* via the open/close valve 106 and fuel supply pipe 107, which are described later. The communication hole 104 is formed in the bottom surface (not shown) of the spatial section 103*a*. Further, the spatial section 103*a* communicates with an evaporative fuel supply path 108.

The communication hole 104 is an element of the fuel return device and gaseous body inflow device. The communication hole 104 is formed in the underside of the spatial section 103*a* in the air chamber 103, which is an element of the fuel adsorption device, that is, formed below the porous body 105. The communication hole 104 allows the air (evaporative fuel S included) in the fuel tank 102 to enter the air chamber 103, which is an element of the fuel adsorption device. The liquid fuel R' dropped from the porous body 105, which is described later, returns from the communication hole 104 to mix with the liquid fuel R in the fuel tank 102. Although the communication hole 104 is formed in the bottom surface of the air chamber 103, it may alternatively be provided in the lower part of a lateral surface of the air chamber 103. Further, the air chamber 103 has a flat bottom surface in which the communication hole 104 is provided. Alternatively, however, the bottom surface of the air chamber 103 may be sloped so that the liquid fuel R' remaining on the bottom surface readily moves to the communication hole 104.

The porous body 105 is a material body, which has many holes in the surface and interior such as active carbon. When the liquid fuel R' pressurized by the fuel pump 108 is supplied to the spatial section 103*a* of the air chamber 103 via the open/close valve 106 and fuel supply pipe 107, which are described later, the liquid fuel R' permeates the porous body 105 through the surface of the porous body 105, that is, through the surface communicating with the evaporative fuel supply path 109 (this surface is hereinafter referred to as the "upper surface"). In this instance, the liquid fuel R' accumulates on the upper surface of the porous body 105 as indicated in the figure. Then, part of the low-boiling-point light fuel, which is contained in the liquid fuel R', spontaneously vaporizes and turns into evaporative fuel S, which fills the spatial section 103*a* of the air chamber 103.

Meanwhile, the liquid fuel R' that has permeated the porous body 105 enters many holes formed in the porous body 105 and is adsorbed as microscopically granulated liquid fuel R'. If the liquid fuel R' is already adsorbed by many holes in the porous body 105, no more liquid fuel R' will be adsorbed by the holes in the porous body 105. The liquid fuel R' that is not adsorbed by the porous body 105 moves through the porous body 105 until it reaches the surface of the porous body 105, that is, the surface provided with the communication hole 104 (this surface is hereinafter referred to as the "lower surface"). When the liquid fuel R' that has moved to the lower surface of the porous body 105 gathers, the liquid fuel R' cannot remain on the lower surface of the porous body 105 and drops down onto a bottom surface (not shown) of the spatial section 103*a* in the air chamber 103. The liquid fuel R' that has dropped onto the bottom surface further drops down via the communication hole 104, which serves as a return device, and mixes with the liquid fuel R that is stored in the fuel tank 102.

The open/close valve 106 is controlled by an open/close signal that is transmitted from a control device 111. As indicated by arrow A in the figure, the liquid fuel R pressurized by the fuel pump 108, which is described later, is handled as liquid fuel R' and supplied to the upper surface of the porous body 105 in the spatial section 103*a* via the fuel supply pipe 107.

The fuel supply pipe 107 supplies liquid fuel R', which is pressurized fuel, to the spatial section 103*a* of the air chamber 103 from a fuel pipe 108*a* for the fuel pump 108. One end of the fuel supply pipe 107 communicates with the fuel pipe 108*a* for the fuel pump 108, and the other end communicates with the spatial section 103*a* of the air chamber 103 in order to supply liquid fuel R' to the upper surface of the porous body 105.

Upon receipt of a drive signal from the control device 111, the fuel pump 108 pressurizes the liquid fuel R in the fuel tank 102 and supplies the liquid fuel R to a fuel injection valve such as an injector via a fuel path 108*a*. The liquid fuel R supplied to the fuel injection valve is forwarded to the internal combustion engine's intake port or cylinder.

The evaporative fuel supply path 109 is used to supply evaporative fuel S in the fuel tank 102, that is, in the air chamber 103, to the internal combustion engine. One end of the evaporative fuel supply path 109 communicates with the upper side of the spatial section 103*a* in the air chamber, that is, the upper spatial section 103*a* of the porous body 105. The other end of the evaporative fuel supply path 109 communicates with components at the intake end of the internal combustion engine such as an intake path, surge tank, and intake manifold that are positioned downstream of an air filter.

The purge valve (VSV) 110 is a negative pressure introduction device, which is an element of the gaseous body inflow device. In compliance with an open/close signal fed from the control device 111, the purge valve 110 controls the communication between the evaporative fuel supply path 109 that is positioned upstream of the purge valve 110 and the evaporative fuel supply path 109 that is positioned downstream of the purge valve 110 as indicated in the figure. When the purge valve 110 opens, the negative pressure generated on the intake side of the internal combustion engine is introduced into the air chamber 103 via the evaporative fuel supply path 109 as indicated by arrow B. Consequently, the pressure P1 within the air chamber 103 is temporarily lower than the pressure P2 within the fuel tank 102. When the pressure P1 within the air chamber 103 decreases, the microscopically granulated liquid fuel R' that is adsorbed by the porous body 105 is more likely to vaporize than in a case where the pressure P1 within the air chamber 103 is equal to the pressure P2 within the fuel tank 102. In other words, when the pressure P1 within the air chamber 103 decreases, the boiling point of liquid fuel R' further lowers. Therefore, the light fuel, which has a low boiling point, readily vaporizes. Further, the heavy fuel, which has a high boiling point, can be partly vaporized. As a result, the air chamber 103 is filled with an increased amount of evaporative fuel S.

Further, when the spatial section 103*a* of the air chamber 103 is placed under negative pressure, the gaseous body in the fuel tank 102, that is, air (evaporative fuel S included), is introduced into the spatial section 103*a* via the communication hole 104, which is an element of the gaseous body inflow device. The air introduced into the spatial section 103*a* flows into the porous body 105. In this instance, the air introduced into the porous body 105 comes into contact with the microscopically granulated liquid fuel R' that is adsorbed by the porous body 105. Such contact with air accelerates the vaporization of the low-boiling-point light fuel, which is contained in the liquid fuel R' adsorbed by the porous body 105. When vaporized, the light fuel is discharged, together with air, into the spatial section 103*a* of the air chamber 103 from the upper surface of the porous body 105.

Meanwhile, when the air chamber 103 is placed under negative pressure, the evaporative fuel S in the air chamber 103, that is, evaporative fuel S that fills the spatial section 103*a* on the upper side and evaporative fuel S that is obtained through the evaporation of the liquid fuel R', which is adsorbed by the porous body 105, is supplied to the intake end of the internal combustion engine via the evaporative fuel supply path 109 as indicated by arrow C. This increases the amount of evaporative fuel S in the fuel tank 102, particularly the amount of evaporative fuel S that fills the spatial section 103*a* of the air chamber 103. Therefore, a large amount of evaporative fuel S can be supplied to the internal combustion engine while it is cold.

The control device 111 receives input signals from sensors mounted in various sections of the internal combustion engine. The input signals to be received include the signals indicating the engine revolving speed Ne or cooling water temperature THW. Further, the control device 111 outputs, for instance, an open/close signal to the open/close valve 106, a drive signal to the fuel pump 108, and an open/close signal to the purge valve 110. The control device 111 comprises an interface section 111*a*, a processing section 111*b*, and a storage section 111*c*. The interface section 111*a* provides input/output of the above input signals and output signals. The processing section 111*b* calculates, for instance, the valve opening timing and valve opening ratio (VSV opening) of the purge valve 110. The control device 111 may be implemented by dedicated hardware. The processing section 111*b* may comprise a memory and a CPU (Central Processing Unit), and implement a control method by loading a program based on the control method, which is described later, into a memory and executing the program. As described in conjunction with a foregoing embodiment, the control device 111 may be incorporated in the ECU (Engine Control Unit), which controls the internal combustion engine. The storage section 111*c* may comprise a flash memory or other nonvolatile memory, a ROM (Read Only Memory) or other volatile read-only memory, a RAM (Random Access Memory) or other volatile read/write memory, or a combination of these.

The control method exercised by the evaporative fuel treatment apparatus will now be described. FIG. 17 is a flowchart illustrating a purge control operation that is performed by the present embodiment of an evaporative fuel treatment apparatus. FIG. 18 illustrates a typical map configuration for the VSV opening and cooling water temperature. As indicated in FIG. 17, the processing section 111*b* of the control device 111 judges whether the engine revolving speed Ne is higher than a predetermined revolving speed Ne1 (step 301). Step 301 is performed to judge whether the internal combustion engine is already started. The reason is that the internal combustion engine can be judged to be cold and in need of a large amount of evaporative fuel S supply in a majority of cases where the internal combustion engine starts. The predetermined revolving speed Ne1 may be any speed that is lower than the idling revolving speed. If the engine revolving speed Ne is not higher than the predetermined revolving speed Ne1, step 301 is repeated.

If the engine revolving speed Ne is higher than the predetermined revolving speed Ne1, the processing section 111*b* judges whether the internal combustion engine's cooling water temperature THW is higher than a predetermined water temperature THW1 (step 302). Processing step 302 is performed to judge whether the cooling water temperature THW indicates a cold internal combustion engine. The predetermined water temperature THW1 may be any temperature that is approximately between 50° C. and 60° C. If the internal combustion engine's cooling water temperature THW is higher than the predetermined water temperature THW1, the processing section 111*b* turns OFF the purge valve 110 (step 303). If the evaporative fuel supply path 109 located upstream of the purge valve 110 communicates with the evaporative fuel supply path 109 located downstream of the purge valve 110, the processing section 111*b* stops a valve open signal that is output from the interface section 111*a* to the purge valve 110, which serves as a negative pressure introduction device, in order to close the purge valve 110 and disconnect the evaporative fuel supply path 109 located upstream of the purge valve 110 from the evaporative fuel supply path 109 located downstream of the purge valve 110. As a result, the spatial section 103*a* of the air chamber 103 is no longer placed under negative pressure so that the liquid fuel R' permeates the porous body 105.

Next, the processing section 111*b* turns ON the open/close valve 106 (step 304). More specifically, the interface section 111*a* outputs an valve open signal to the open/close valve 106, letting the evaporative fuel supply pipe 109 located upstream of the open/close valve 106 communicate with the evaporative fuel supply pipe 109 located downstream of the open/close valve 106 and supplying liquid fuel R, which is pressurized by the fuel pump 108, to the spatial section 103*a* of the air chamber 103 as liquid fuel R'. One part of liquid fuel R', which is supplied to the spatial section 103*a* of the air chamber 103, that is, the upper surface of the porous body 105, is spontaneously vaporized over the upper surface of the porous body 105. Another part is adsorbed by the porous body 105. The remaining part drops onto the bottom surface (not shown) of the spatial section 103*a* in the air chamber 103 from the lower surface of the porous body 105, and returns via the communication hole 4 to mix with liquid fuel R in the fuel tank 102.

Next, the processing section 111*b* judges whether the amount Q of liquid fuel R' supply from the fuel supply pipe 107 to the spatial section 103*a* of the air chamber 103 is not smaller than a predetermined value Q1 (step 305). The predetermined value Q1 should be not smaller than a value that is obtained by adding the amount of liquid fuel R' that can be adsorbed by the porous body 105 to the amount of spontaneous fuel vaporization from liquid fuel R'. This ensures that the amount of liquid fuel R' supply to the upper surface of the porous body 105 is equal to the amount of liquid fuel R' that can be adsorbed by the porous body 105. Therefore, the porous body 105 can adsorb a fixed amount of liquid fuel R'.

If the amount of liquid fuel R' supply from the fuel supply pipe 107 to the spatial section 103*a* of the air chamber 103 is not smaller than the predetermined amount Q1, the processing section 111*b* turns OFF the open/close valve 106 (step 306). If the fuel supply pipe 107 located upstream of the open/close valve 106 communicates with the fuel supply pipe 107 located downstream of the open/close valve 106, the processing section 111*b* stops a valve open signal, which is output from the interface section 111*a* to the open/close valve 106, to close the open/close valve 106, thereby disconnecting the fuel supply pipe 107 located upstream of the open/close valve 106 from the fuel supply pipe 107 located downstream of the open/close valve 106 and stopping the supply of liquid fuel R' to the spatial section 103*a* of the air chamber 103. If the above-mentioned supply amount Q is smaller than the predetermined value Q1, step 305 is repeated.

If the internal combustion engine's cooling water temperature THW is not higher than the predetermined water temperature THW1, the processing section 111*b* turns ON the purge valve (step 307). The interface section 111*a* outputs a valve opening ratio signal to the purge valve 110 to control the amount of evaporative fuel S supply to the internal combustion engine. As shown in FIG. 18, the purge valve 110 is subjected to duty control that is exercised in accordance with the map, which is stored in the storage section 111*c* to define the relationship between the VSV opening and cooling water temperature THW. The map is set so that the VSV opening decreases when the cooling water temperature THW increases. This ensures that the amount of evaporative fuel S supply to the internal combustion engine can be controlled in accordance with the cooling water temperature THW prevailing while the internal combustion engine is cold. After the open/close valve 106 is turned OFF in step 306 or the purge valve 110 is turned ON in step 307, processing steps 301 through 307 are repeated.

As described above, liquid fuel R' is supplied to the upper surface of the porous body 105, which is positioned within the fuel adsorption device, that is, the spatial section 103*a* of the air chamber 103. Fuel other than microscopically granulated liquid fuel R' that is adsorbed by many holes in the porous body 105, particularly heavy fuel, which has a high boiling point, drops down from the lower surface of the porous body 105. The dropped liquid fuel R' returns to the fuel tank 102 via the communication hole 104, which is provided in the bottom surface (not shown) of the spatial section 103*a* in the air chamber 103, and then mixes with liquid fuel R, which is stored in the fuel tank 102. In other words, unvaporized fuel, particularly, high-boiling-point heavy fuel that cannot vaporize while the internal combustion engine is cold, mixes with liquid fuel R, which is stored in the fuel tank 102. This makes it possible, for instance, to inhibit unvaporized fuel from being supplied to the internal combustion engine while it is cold, improve the startability of the internal combustion engine while it is cold, and minimize the possibility of unburned hydrocarbon generation.

Further, the porous body 105 positioned in the spatial section 103*a* of the air chamber 103 is allowed to adsorb liquid fuel R' while the internal combustion engine is warm, and liquid fuel R', which is adsorbed by the porous body 105, particularly unvaporized light fuel is vaporized while the internal combustion engine is cold so that evaporative fuel S in the fuel tank 102 is needed. As a result, while the internal combustion engine is cold, the fuel tank 102 is filled with evaporative fuel S, which comprises fuel that is spontaneously vaporized in the fuel tank 102 and fuel that is vaporized when the air in the fuel tank 102 flows into the porous body 105. This ensures that a steady amount of evaporative fuel S can be supplied to the internal combustion engine while it is cold.

The evaporative fuel treatment apparatus according to the present embodiment has the air chamber 103, which is a fuel adsorption device, and the porous body 105 in the fuel tank 102. Therefore, even if evaporative fuel S leaks out of the air chamber 103, it mixes with the air in the fuel tank 102. In marked contrast to a conventional evaporative fuel treatment apparatus that is provided with a charcoal canister for storing evaporative fuel between the fuel tank and purge valve, the evaporative fuel treatment apparatus according to the present embodiment can properly inhibit the evaporative fuel S from leaking out of the evaporative fuel treatment apparatus.

In the present embodiment described above, the amount Q of liquid fuel R' supply from the fuel supply pipe 107 to the fuel adsorption device, that is, the time during which the open/close valve 106 is open, is determined at least in accordance with the amount of liquid fuel R' adsorbed by the porous body 105. Therefore, the control device 111 may determine the amount of liquid fuel R' to be adsorbed by the porous body 105 in accordance, for instance, with the outside air temperature and control the time during which the open/close valve 106 is open. This ensures that an appropriate amount of evaporative fuel S can be supplied to the internal combustion engine while it is cold.

The description of the present embodiment deals with a case where liquid fuel R', which is supplied from the fuel supply pipe 107, is directly supplied to the upper surface of the porous body 105. However, the present invention is not limited to such a case. A filter may alternatively be mounted on the upper surface of the porous body 105. This filter can remove impurities that are contained in liquid fuel R'. The filter can also delay the time for allowing liquid fuel R' to permeate the porous body 105. Because of such a delay, the low-boiling-point light fuel contained in liquid fuel R' can spontaneously evaporate. As a result, an increased amount of evaporative fuel S fills the upper side of the spatial section 103*a* in the air chamber 103.

Tenth Embodiment

Figure 19:
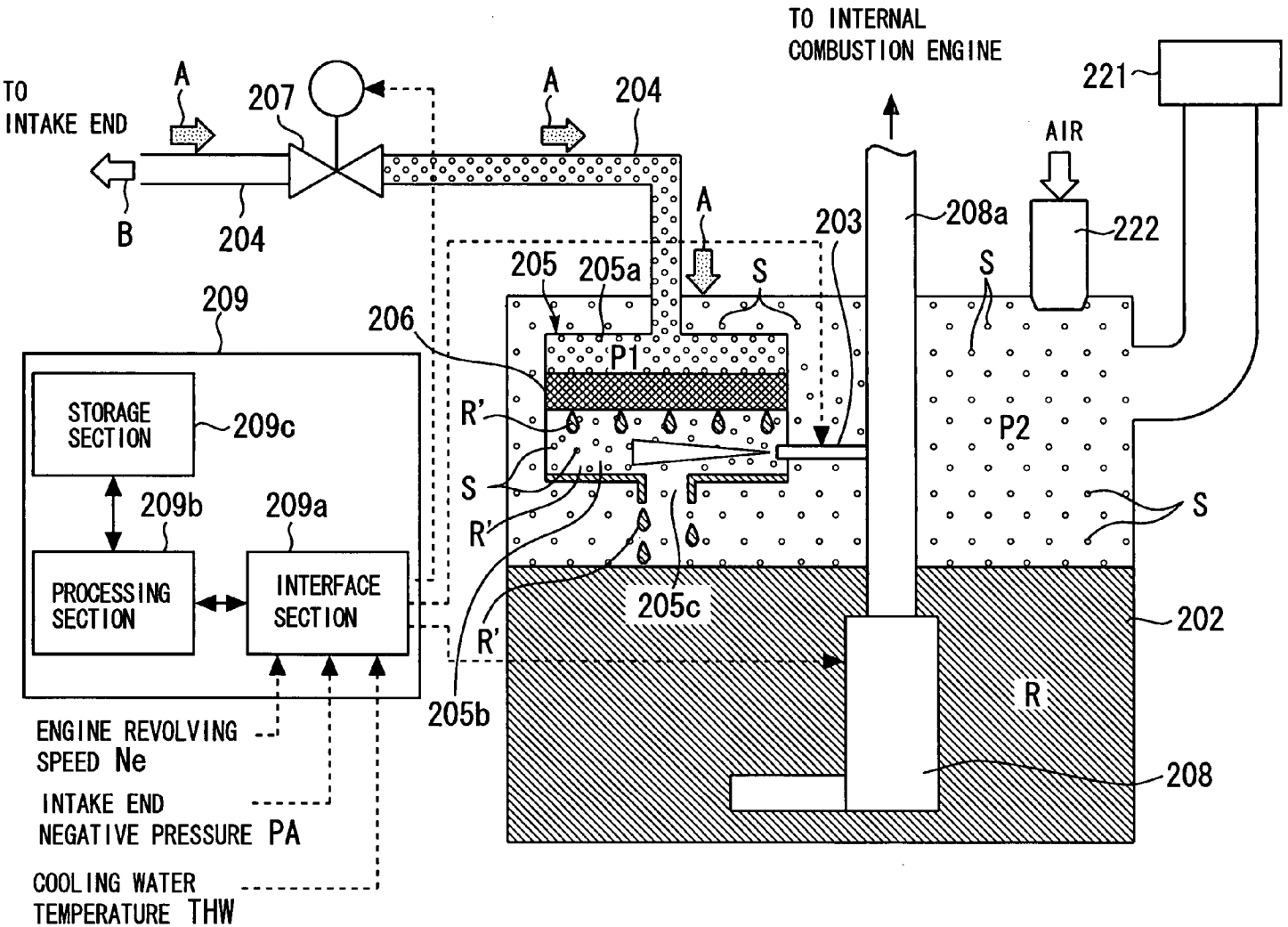
FIG. 19 illustrates the configuration of a tenth embodiment of an evaporative fuel treatment apparatus according to the present invention.
Figure 20:
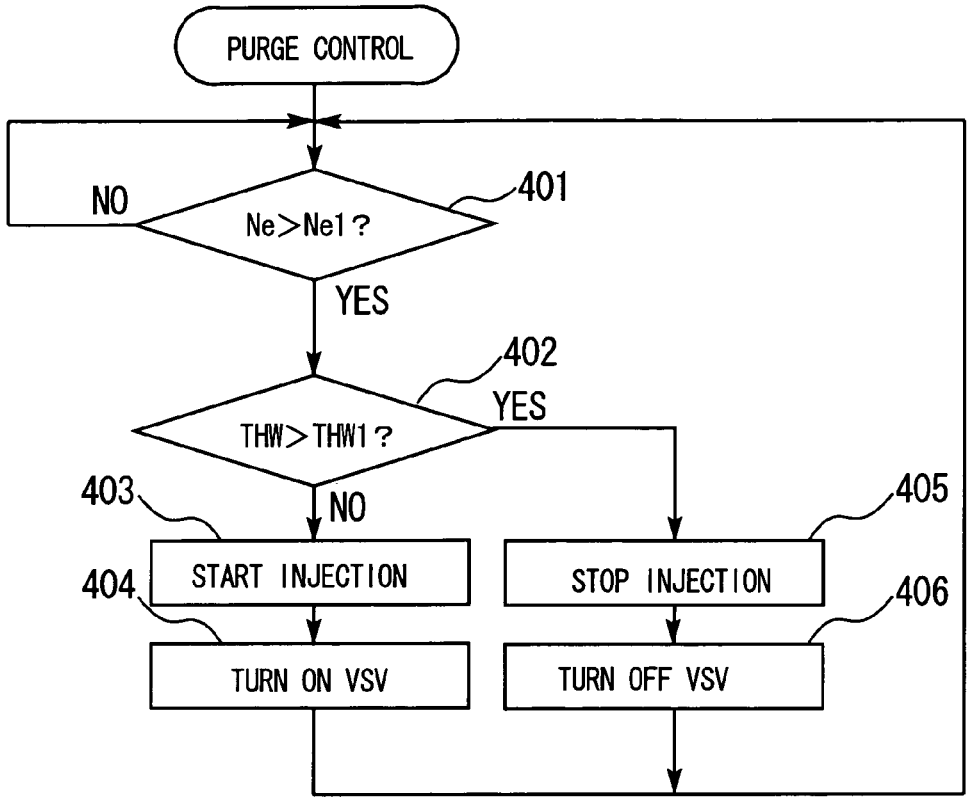
FIG. 20 is a flowchart illustrating a purge control routine that is executed in a tenth embodiment of the present invention.
Figure 21:
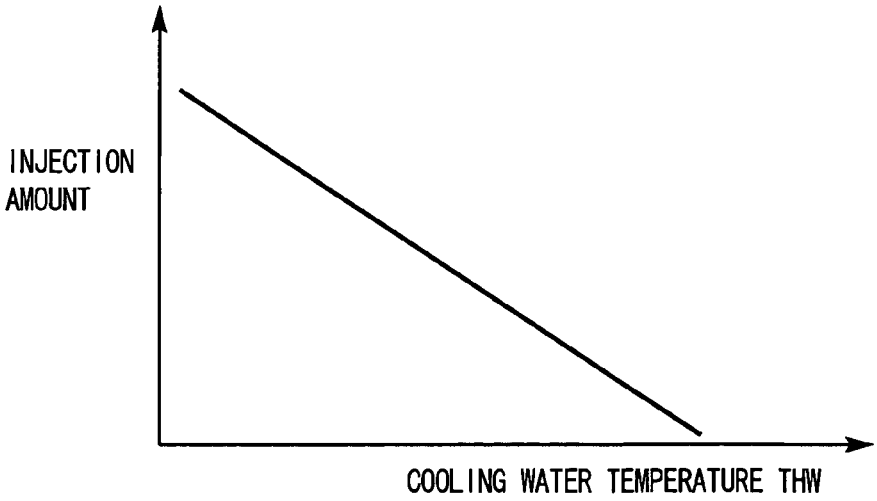
FIG. 21 illustrates a typical map configuration for the injection amount and cooling water temperature.

A tenth embodiment of the present invention will now be described with reference to FIGS. 19 through 21. FIG. 19 outlines the tenth embodiment of an evaporative fuel treatment apparatus. As shown in the figure, the evaporative fuel treatment apparatus according to the present embodiment comprises at least a fuel tank 202; an injector 203, which serves as a fuel injection device; an evaporative fuel supply path 204; an air chamber 205; a porous body 206, which serves as an evaporation acceleration body and as an evaporative fuel adsorption body; and a purge valve (VSV) 207, which serves as a negative pressure introduction device.

The above-mentioned air chamber 205 and a fuel pump 208 are mounted inside the fuel tank 202. The fuel tank 202 is provided with an air introduction hole 222. When the pressure within the fuel tank 202 lowers, the air introduction hole 222 introduces the air outside the fuel tank 202 for the purpose of maintaining a constant pressure within the fuel tank 202. The air introduction hole 222 also prevents the air in the fuel tank 202 from flowing out of the fuel tank 202. This function is exercised to inhibit evaporative fuel S, which is mixed with the air in the fuel tank 202, from leaking out of the fuel tank 202. Liquid fuel R, which is supplied from a fuel supply hole 221, contains a mixture of light fuel, which has a low boiling point, and heavy fuel, which has a high boiling point. The fuel tank 202 is filled with air that is introduced from the air introduction hole 222. The low-boiling-point light fuel that is contained in liquid fuel R, which is stored in the fuel tank 202, spontaneously vaporize over the surface of liquid fuel R. Evaporative fuel S, which is vaporized fuel, mixes with the air in the fuel tank 202 and fills the fuel tank 202 as shown in the figure.

The injector 203 is a fuel injection device. Liquid fuel R is supplied to the injector 203 from a fuel path 208*a* of the fuel pump 208. Upon receipt of an injection signal from the control device 209, the injector 203 injects fuel to a lower spatial section 205*b* (described later) of the air chamber 205, that is, the underside of the porous body 206 as shown in the figure. The fuel vaporizes after it is injected from the injector 203. The vaporized fuel contains light fuel and heavy fuel. Due to the injection operation performed by the injector 203, part of the light fuel turns into evaporative fuel S, which is vaporized fuel. Unvaporized light fuel and the heavy fuel, which cannot be vaporized at a temperature and pressure within the air chamber 205, turn into microscopically granulated liquid fuel R'. In other words, when fuel is injected from the injector 203, which is a fuel injection device, the amount of evaporative fuel S contained in the air in the fuel tank 202, particularly, the air in the lower spatial section 205*b* of the air chamber 205, is forcibly increased.

The evaporative fuel supply path 204 is used to supply evaporative fuel S in the air chamber 205 of the fuel tank 202 to the internal combustion engine. One end of the evaporative fuel supply path 204 communicates with the upper spatial section 205*a* in the air chamber 205, that is, the upper side of the porous body 206. The other end of the evaporative fuel supply path 204 communicates with components at the intake end of the internal combustion engine such as an intake path, surge tank, and intake manifold that are positioned downstream of an air filter.

The porous body 206 is positioned inside the air chamber 205. The porous body 206 separates the air chamber 205 into the upper spatial section 205*a* and lower spatial section 205*b*. The bottom surface (not shown) of the lower spatial section 205*b* is provided with an opening 205*c*, which allows the air (evaporative fuel S included) in the fuel tank 202 to be introduced into the air chamber 205. Liquid fuel R', which is contained in fuel that is injected from the injector 203 and vaporized, returns to the fuel tank 202 via the opening 205*c* and reverts to liquid fuel R. The air chamber 205 has a flat bottom surface, which is provided with the opening 205*c*. However, the bottom surface may alternatively be sloped so that liquid fuel R' accumulated on the bottom surface readily moves to the opening 205*c*.

The porous body 206 serves as an evaporation acceleration body and as an evaporative fuel adsorption body. It is made, for instance, of active carbon whose surface and interior have many holes. Liquid fuel R', which is contained in the fuel that is injected from the injector 203 and vaporized, is temporarily retained in holes near the surface (lower surface in the figure) of the porous body 206 as granulated liquid fuel. Neighboring granules of liquid fuel R' then gather, and drop onto the bottom surface of the air chamber 205. When temporarily retained, liquid fuel R' increases its surface area in order to maintain its granular state. Therefore, light fuel, which is contained in liquid fuel R' and still not vaporized is urged to become vaporized and serve as evaporative fuel. To achieve such a purpose, the porous body 206 is capable of serving as an evaporation acceleration body. Consequently, the fuel tank 202, particularly the air chamber 205, is filled with evaporative fuel S, which comprises fuel that is spontaneously vaporized in the fuel tank 202, fuel that is vaporized due to injection from the injector 203, and fuel that is vaporized by the action of the porous body 206, which serves as an evaporation acceleration body. This ensures that the fuel tank 202, particularly the air chamber 205, is filled with an increased amount of evaporative fuel S.

Further, evaporative fuel S that is injected from the injector 203, atomized, and vaporized, and evaporative fuel S that is introduced into the air chamber 205 from the fuel tank 202 via the opening 205*c* both enter many holes in the porous body 206 and maintain their status. In other words, since evaporative fuel S is adsorbed by the porous body 206, the porous body 206 functions as an evaporative fuel adsorption body. The amount of evaporative fuel S that can be adsorbed by the porous body 206 is proportional to the cubic volume of the porous body 206. The porous body 206 can adsorb a fixed amount of evaporative fuel. For evaporative fuel supply to the intake end of the internal combustion engine, the evaporative fuel S is supplied via the evaporative fuel supply path 204 after the evaporative fuel S adsorbed by the porous body 206 moves to the upper spatial section 205*a* of the air chamber 205 under negative pressure that is introduced via the evaporative fuel supply path 204, which is described later. As a result, a steady amount of evaporative fuel can be supplied to the internal combustion engine.

The purge valve (VSV) 207 is a negative pressure introduction device, which, as shown in the figure, controls the communication between the upstream evaporative fuel supply path 204 and downstream evaporative fuel supply path 204 upon receipt of an open/close signal from the control device 209. When the purge valve 207 opens, a negative pressure generated at the intake end of the internal combustion engine is introduced into the air chamber 205 via the evaporative fuel supply path 204 as indicated by arrow A. As a result, the pressure P1 within the air chamber 205 is temporarily lower than the pressure P2 within the fuel tank 202. When the pressure P1 within the air chamber 205 decreases, the liquid fuel R' contained in fuel that is injected from the injector 203 and atomized is more likely to vaporize than in a case where the pressure P1 within the air chamber 205 is equal to the pressure P2 within the fuel tank 202. In other words, when the pressure P1 within the air chamber 205 decreases, the boiling point of liquid fuel R' further lowers. Therefore, the light fuel, which has a low boiling point, becomes more likely to vaporize. Further, the heavy fuel, which has a high boiling point, can be partly vaporized. As a result, the air chamber 205 is filled with an increased amount of evaporative fuel S.

When a negative pressure is introduced into the air chamber 205, the evaporative fuel S in the air chamber 205, that is, the evaporative fuel S adsorbed by the porous body 206 and the evaporative fuel S that fills the lower spatial section 205*b* of the air chamber 205, is transferred to the upper spatial section 205*a* and then supplied to the intake end of the internal combustion engine via the evaporative fuel supply path 204 as indicated by arrow B. Therefore, the purge valve 207 can not only make the pressure P1 within the air chamber 205 lower than the pressure P2 within the fuel tank 202, but also supply the evaporative fuel S in the air chamber 205 to the internal combustion engine. This makes it possible to minimize the number of parts required for the evaporative fuel treatment apparatus as well as the production cost.

Upon receipt of a drive signal from the control device 209, the fuel pump 208 pressurizes the liquid fuel R in the fuel tank 202 and supplies it to the injector or other fuel injection valve via the fuel path 208*a*. The liquid fuel R supplied to the fuel injection valve is forwarded into either the internal combustion engine's intake port or cylinder.

The control device 209 receives input signals indicating, for instance, the engine revolving speed Ne, intake end negative pressure PA, and cooling water temperature THW from sensors mounted at various places in the internal combustion engine, and outputs an injection signal to the injector 203, an open/close signal to the purge valve 207, a drive signal to the fuel pump 208, and other signals in accordance with various maps stored in the storage section 209*c*. More specifically, the control device 209 comprises an interface section 209*a* for inputting/outputting the above input signals and output signals, a processing section 209*b* for calculating, for instance, the injection timing of the injector 203 and the amount of injection, and a storage section 209*c* for storing, for instance, the above-mentioned maps. The control device 209 may be implemented by dedicated hardware. The processing section 209*b* may comprise a memory and a CPU (Central Processing Unit), and implement a fuel injection method by loading a program based on the fuel injection method, which is described later, into a memory and executing the program. Further, the control device 209 may be incorporated in the ECU (Engine Control Unit), which controls the internal combustion engine. The storage section 209*c* may comprise a flash memory or other nonvolatile memory, a ROM (Read Only Memory) or other volatile read-only memory, a RAM (Random Access Memory) or other volatile read/write memory, or a combination of these.

The control method exercised by the evaporative fuel treatment apparatus will now be described. FIG. 20 is a flowchart illustrating a purge control operation that is performed by the present embodiment of an evaporative fuel treatment apparatus. FIG. 21 illustrates a typical map configuration for the injection amount and cooling water temperature. As indicated in FIG. 20, the processing section 209*b* of the control device 209 first judges whether the engine revolving speed Ne is higher than a predetermined revolving speed Ne1 (step 401). Step 401 is performed to judge whether the internal combustion engine is already started. The reason is that the internal combustion engine can be judged to be cold and in need of a large amount of evaporative fuel S supply in a majority of cases where the internal combustion engine starts. The predetermined revolving speed Ne1 may be any speed that is lower than the idling revolving speed. If the engine revolving speed Ne is not higher than the predetermined revolving speed Ne1, step 401 is repeated.

If the engine revolving speed Ne is higher than the predetermined revolving speed Ne1, the processing section 209*b* judges whether the internal combustion engine's cooling water temperature THW is higher than a predetermined water temperature THW1 (step 402). Processing step 402 is performed to judge whether the cooling water temperature THW indicates a cold internal combustion engine. The predetermined water temperature THW1 may be any temperature that is approximately between 50° C. and 60° C. If the internal combustion engine's cooling water temperature THW is not higher than the predetermined water temperature THW1, the processing section 209*b* turns ON the injector 203 to initiate its injection operation (step 403). The processing section 209*b* outputs an injection signal to the injector 203 via the interface section 209*a* and controls the amount of fuel injection from the injector 203. As indicated in FIG. 21, the injection amount is determined according to a map that is stored in the storage section 209*c* to define the relationship between the injection amount and cooling water temperature THW. This map is set so that the amount of fuel injection from the injector 203 decreases when the cooling water temperature THW increases. The map sets the injection amount in accordance with the cooling water temperature THW. However, the present invention is not limited to such map setup. For example, the map may alternatively be set so that the injection amount is determined according to the intake end negative pressure PA that is input into the control device 209. The evaporative fuel S that is injected from the injector 203, atomized, and vaporized and the evaporative fuel S that is vaporized from liquid fuel R' when atomized liquid fuel R' is temporarily retained near the surface of the porous body 206, which serves as an evaporation acceleration body, are both adsorbed by the porous body 206, which serves as an evaporative fuel adsorption body. Further, the evaporative fuel S that is introduced into the fuel tank 202 via the opening 205*c* in the air chamber 205 is also adsorbed by the porous body 206.

After the injector 203 is turned ON to initiate its injection operation, the processing section 209*b* turns ON the purge valve 207 (step 404). The processing section 209*b* then causes the interface section 209*a* to output a valve open signal to the purge valve 207, which serves as a negative pressure introduction device, and allows the evaporative fuel supply path 204 located upstream of the purge valve 207 to communicate with the evaporative fuel supply path 204 located downstream of the purge valve 207. This communication ensures that the negative pressure at the intake end of the internal combustion engine is introduced into the air chamber 205 via the evaporative fuel supply path 204. When the air chamber 205 is placed under negative pressure, the pressure P1 within the air chamber 205 is lower than the pressure P2 within the fuel tank 202. As a result, the air in the fuel tank 202 (including the evaporative fuel S in the fuel tank 202) is introduced into the air chamber 205. The air introduced into the air chamber 205 and the evaporative fuel S adsorbed by the porous body 206 are both supplied to the intake end of the internal combustion engine via the evaporative fuel supply path 204. Liquid fuel R', which is contained in the fuel that is injected from the injector 203 and atomized, drops onto the bottom surface of the air chamber 205 from the surface of the porous body 206. Liquid fuel R', which is now retained on the bottom surface of the air chamber 205, drops into the fuel tank 202 via the opening 205*c* and mixes with liquid fuel R, thereby reverting to liquid fuel R in the fuel tank 202. When air is introduced into the air chamber 205, the pressure P2 within the fuel tank 202 lowers. However, the pressure within the fuel tank 202 is maintained constant because the air outside the fuel tank 202 is introduced from the air introduction hole 222.

If the internal combustion engine's cooling water temperature THW is higher than a predetermined water temperature THW1, the processing section 209*b* turns OFF the injector 203 to stop its injection operation (step 405). If the interface section 209*a* outputs an injection signal to the injector 203, the processing section 209*b* stops its output. After the injector 203 is turned OFF to stop its injection operation, the processing section 209*b* turns OFF the purge valve 207 (step 406). If the evaporative fuel supply path 204 located upstream of the purge valve 207 communicates with the evaporative fuel supply path 204 located downstream of the purge valve 207, the processing section 209*b* closes the purge valve 207 by stopping a valve open signal that is output from the interface section 209*a* to the purge valve 207, thereby disconnecting the evaporative fuel supply path 204 located upstream of the purge valve 207 from the evaporative fuel supply path 204 located downstream of the purge valve 207. If it is found that the internal combustion engine is warm and not cold, the evaporative fuel S is not supplied to the intake end of the internal combustion engine via the evaporative fuel supply path 204. After the purge valve 407 is turned ON in step 404 or turned OFF in step 406, steps 401 through 406 are repeated.

When the injector 203, which serves as a fuel injection device, injects fuel into the fuel tank 202, particularly the air chamber 205, as described above, the low-boiling-point light fuel that is contained in atomized fuel is vaporized by injection. As a result, the fuel tank 202, particularly the air chamber 205, is filled with evaporative fuel S that comprises spontaneously vaporized fuel and fuel vaporized by the above-mentioned fuel injection device. This evaporative fuel S is supplied to the internal combustion engine via the evaporative fuel supply path 204. Meanwhile, the high-boiling-point heavy fuel that is contained in fuel atomized by injection and unvaporized light fuel both continue to be microscopically granulated liquid fuel R' and mix with liquid fuel R that is stored in the fuel tank 202. Particularly, the heavy fuel, which has a high boiling point and cannot vaporize while the internal combustion engine is cold, reverts to liquid fuel R, which is stored in the fuel tank 202. This makes it possible to supply a large amount of evaporative fuel S to the internal combustion engine while it is cold and inhibit unvaporized fuel from being supplied to the internal combustion engine while it is cold. As a result, the cold startability of the internal combustion engine can be improved while minimizing the possibility of unburned hydrocarbon generation.

The fuel tank 202 of the evaporative fuel treatment apparatus according to the present embodiment has the air chamber 205, which is provided with the porous body 206 that adsorbs evaporative fuel S. Therefore, even if evaporative fuel S leaks out of the air chamber 205, it mixes with the air in the fuel tank 202. In marked contrast to a conventional evaporative fuel treatment apparatus that is provided with a charcoal canister for storing evaporative fuel between the fuel tank and purge valve, the evaporative fuel treatment apparatus according to the present embodiment can properly inhibit the evaporative fuel S from leaking out of the evaporative fuel treatment apparatus.

Eleventh Embodiment

Figure 22:
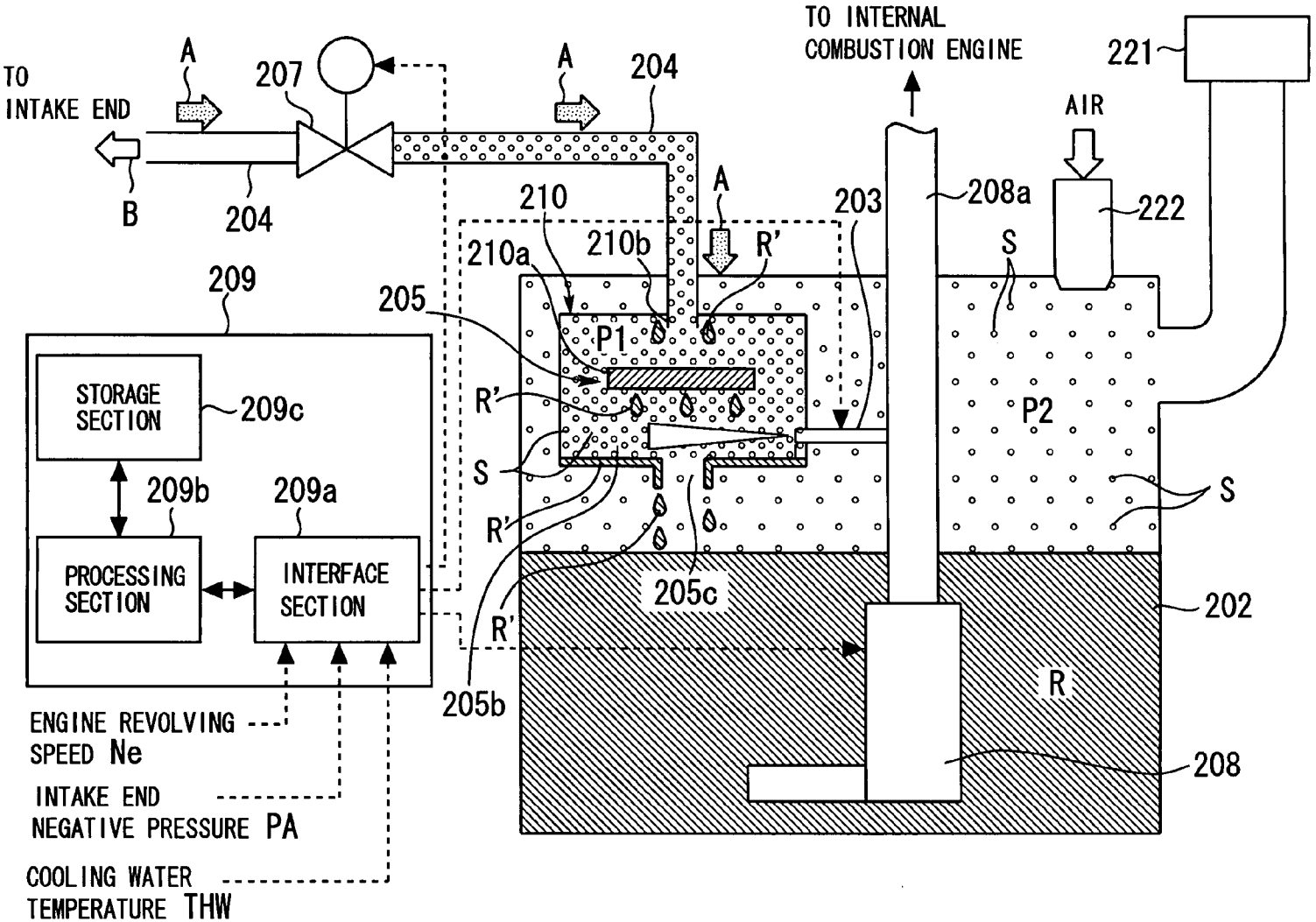
FIG. 22 illustrates the configuration of an eleventh embodiment of an evaporative fuel treatment apparatus according to the present invention.

An eleventh embodiment of the present invention will now be described with reference to FIG. 22. FIG. 22 outlines the eleventh embodiment of an evaporative fuel treatment apparatus according to the present invention. The evaporative fuel treatment apparatus shown in FIG. 22 differs from the one shown in FIG. 19 in that a liquid/vapor separator 210 is furnished in place of the porous body 206. The basic configuration of the evaporative fuel treatment apparatus shown in FIG. 22 will not be described because it is the same as that of the evaporative fuel treatment apparatus shown in FIG. 19. Further, the purge control method adopted by the evaporative fuel treatment apparatus shown in FIG. 22 will not be described because it is the same as indicated in the flowchart in FIG. 20.

As shown in FIG. 22, the liquid/vapor separator 210 comprises a first liquid/vapor separator 210*a* and a second liquid/vapor separator 210*b*. The first liquid/vapor separator 210*a* is a plate-like member that is positioned above the injector 203. The second liquid/vapor separator 210*b* is one end of the evaporative fuel supply path 204 that protrudes into the air chamber 205. Fuel injected from the injector 203, which serves as a fuel injection device, and atomized is separated into vaporized evaporative fuel S and unvaporized liquid fuel R' by the first liquid/vapor separator 210*a*. In other words, the first liquid/vapor separator 210*a* causes the vaporized evaporative fuel S to fill the air chamber 205 in which the first liquid/vapor separator 210*a* is positioned, whereas most of the unvaporized liquid fuel R' adheres to the surface (lower surface in the figure) of the first liquid/vapor separator 210*a*. After the unvaporized liquid fuel R' is stuck on the surface of the first liquid/vapor separator 210*a*, neighboring granules of liquid fuel R' then gather, and drop onto the bottom surface of the air chamber 205 as shown in the figure. The first liquid/vapor separator 210*a* has a flat surface onto which liquid fuel R' drops. However, the surface may alternatively be sloped so that liquid fuel R' accumulated on the surface readily gathers.

Liquid fuel R' that does not adhere to the first liquid/vapor separator 210*a* adheres to the wall surface of the air chamber 205. If, in this situation, the purge valve 207 turns ON in step 404, which is shown in FIG. 20, the negative pressure introduced into the air chamber 205 causes liquid fuel R', which is stuck on the wall surface of the air chamber 205, to move along the wall surface. Unlike the air chamber for the tenth embodiment, the air chamber 205 for the present embodiment is not partitioned into the upper spatial section 205*a* and lower spatial section 205*b*. Therefore, liquid fuel R' moves along the wall surface in an attempt to flow into the evaporative fuel supply path 204 that introduces a negative pressure into the air chamber 205. However, one end of the evaporative fuel supply path 204, which serves as the second liquid/vapor separator 210*b*, protrudes into the air chamber 205. Therefore, liquid fuel R', which moves along the wall surface of the air chamber 205, does not flow into the evaporative fuel supply path 204. Liquid fuel R', which has gathered near the second liquid/vapor separator 210*b*, drops onto the first liquid/vapor separator 210*a* or the bottom surface of the air chamber 205 as indicated in the figure. As described above, the first liquid/vapor separator 210*a* separates fuel that is injected from the injector 203, which serves as a fuel injection device, and atomized, into evaporative fuel S that is vaporized by injection and microscopically granulated, unvaporized liquid fuel R'. The second liquid/vapor separator 210*b* inhibits microscopically granulated, unvaporized liquid fuel R' from entering the evaporative fuel supply path 204. This ensures that unvaporized fuel is properly blocked from being supplied to the internal combustion engine while it is cold.

Twelfth Embodiment

Figure 23:
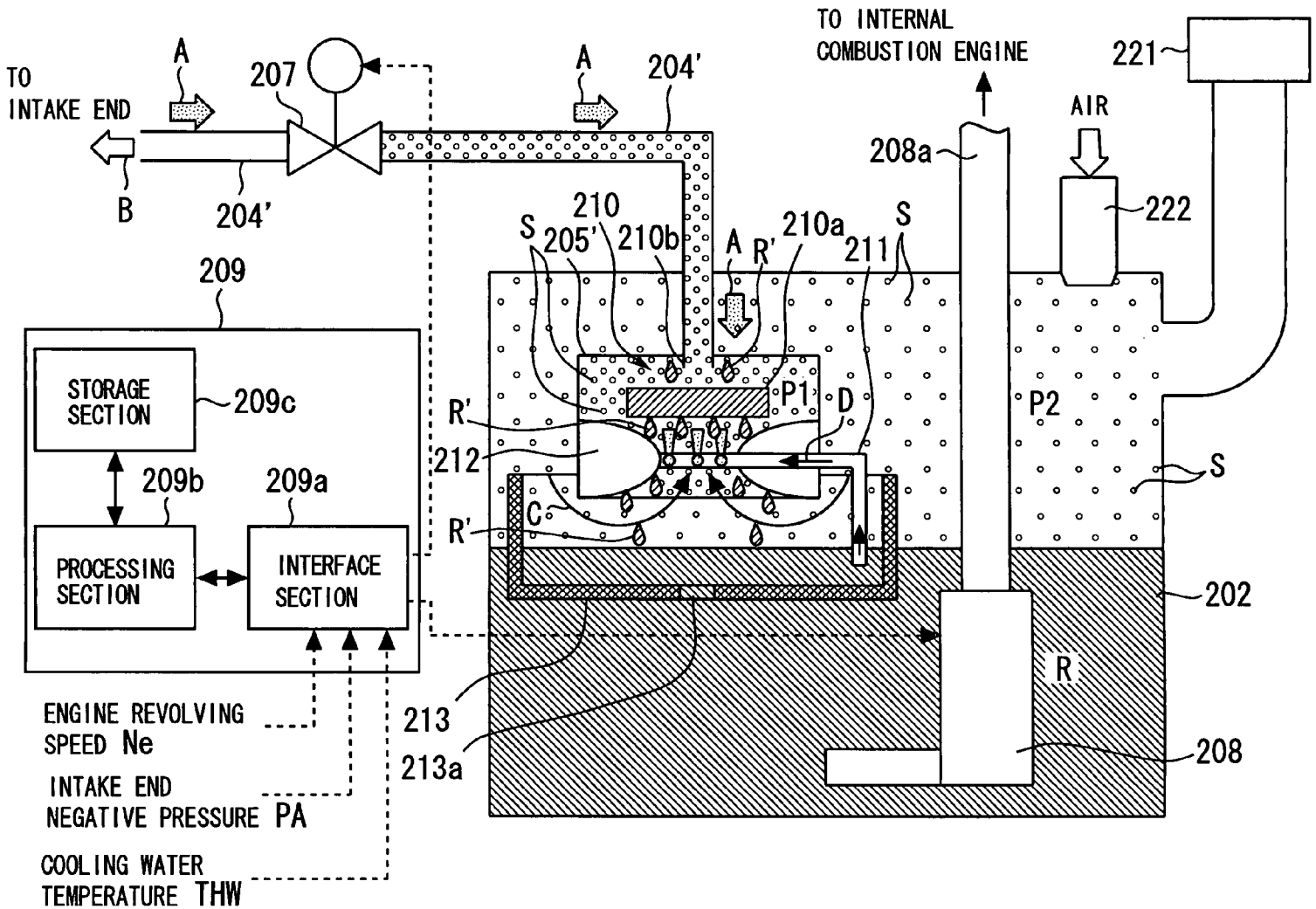
FIG. 23 illustrates the configuration of a twelfth embodiment of an evaporative fuel treatment apparatus according to the present invention.

A twelfth embodiment of the present invention will now be described with reference to FIG. 23. FIG. 23 outlines the twelfth embodiment of an evaporative fuel treatment apparatus according to the present invention. The evaporative fuel treatment apparatus shown in FIG. 23 differs from the one shown in FIG. 22 in that the former has a liquid fuel supply path 211 in place of the injector 203, which serves as a fuel injection device, and a venturi device 212, which serves as a flow velocity increase device. The basic configuration of the evaporative fuel treatment apparatus shown in FIG. 23 will not be described because it is the same as that of the evaporative fuel treatment apparatus shown in FIG. 22. Further, the purge control method adopted by the evaporative fuel treatment apparatus shown in FIG. 23 will not be described because it is the same as indicated in the flowchart in FIG. 20 except that no injection control is exercised over the injector 203, which serves as a fuel injection device.

As shown in FIG. 23, an air chamber 205' is positioned in the fuel tank 202 and secured to a float 213. The air chamber 205' moves up or down within the fuel tank 202 in coordination with the vertical motion of the float 213. The bottom surface of the air chamber 205' has an opening. When a negative pressure is introduced into the air chamber 205' via an evaporative fuel supply path 204', the air (including the evaporative fuel S in the fuel tank 202) in the fuel tank 202 flows into the air chamber 205' as indicated by arrow C. The float 213 moves up or down in coordination with the vertical motion of the surface of liquid fuel R within the fuel tank 202. The float 213 is provided with a liquid fuel introduction hole 213*a*, which introduces liquid fuel R in the fuel tank 202. Therefore, the level of liquid fuel R introduced into the float 213 is substantially equal to that of liquid fuel R within the fuel tank 202. To ensure that the vertical motion of the air chamber 205' is not obstructed, the evaporative fuel supply path 204', particularly the evaporative fuel supply path 204' located upstream of the purge valve 207, comprises, for instance, a telescopic pipe that is extensible and compressible in accordance with the vertical motion of the air chamber 205'.

The liquid fuel supply path 211 is used so that liquid fuel R, which is introduced into the float 213, is supplied to the air chamber 205'. One end of the liquid fuel supply path 211 is provided with a plurality of microscopic fuel injection holes 211*a* (three holes in the figure), and the other end is positioned below the surface of liquid fuel R that is introduced into the float 213. When the negative pressure introduced from the evaporative fuel supply path 204' makes the pressure P1 within the air chamber 205' lower than the pressure P2 within the fuel tank 202, the liquid fuel supply path 211, which is a fuel injection device, introduces liquid fuel R in the float 213 in a direction indicated by arrow D from the other end in accordance with the pressure difference between P1 and P2. Liquid fuel R, which is introduced in the above manner, is then injected from the fuel injection holes 211*a* in one end of the liquid fuel supply path 211 and atomized. Unlike the tenth embodiment in which the injector 203 is used, the present embodiment can therefore supply atomized fuel to the air chamber 205' without using the injector 203. This eliminates the necessity of using an expensive fuel injection device, thereby minimizing the production cost for the evaporative fuel treatment apparatus.

The venturi device 212, which serves as a flow velocity increase device, that is, the aperture diaphragm, is positioned in the air chamber 205'. The fuel injection holes 211*a* in the liquid fuel supply path 211 are positioned at the center of the venturi device 212. When the purge valve 207 turns ON, that is, the negative pressure at the intake end of the internal combustion engine is introduced into the air chamber 205' via the evaporative fuel supply path 204', the venturi device 212 causes the air flowing into the air chamber 205' from the fuel tank 202 to decrease in pressure and increase in flow velocity. It means that the velocity of air inflow into the air chamber 205' increases. When a negative pressure is introduced into the air chamber 205', microscopically granulated liquid fuel R', which is contained in fuel that is injected from the fuel injection holes 211*a* in the liquid fuel supply path 211 and atomized, is agitated within the air chamber 205' by air having an increased flow velocity. In other words, low-boiling-point light fuel that is contained in microscopically granulated liquid fuel R' turns out to be evaporative fuel S, which is vaporized by air whose flow velocity is increased. This causes a further increase in the amount of evaporative fuel S that fills the fuel tank 202, particularly the air chamber 205', thereby making it possible to supply an increased amount of evaporative fuel S to the internal combustion engine while it is cold.

When the purge valve 207 turns OFF to stop introducing the negative pressure at the intake end of the internal combustion engine into the air chamber 205' via the evaporative fuel supply path 204', unvaporized liquid fuel R' above the venturi device 212 in the air chamber 205' drops along the surface of the venturi device 212 and into the float 213. This ensures that liquid fuel R' reverts to liquid fuel R in the fuel tank 202.

In the twelfth embodiment described above, the air chamber 205' is merely provided with the liquid/vapor separator 210, which comprises the first liquid/vapor separator 210*a* and second liquid/vapor separator 210*b*. However, the present invention is not limited to such configuration. For example, a porous body 206, which serves as an evaporation acceleration body and evaporative fuel adsorption body, may alternatively be positioned between the first liquid/vapor separator 210*a* and second liquid/vapor separator 210*b* in the air chamber 205'. This also holds true for the eleventh embodiment, which is described earlier.

The major benefits of the present invention described above are summarized follows:

According to a first aspect of the present invention, the interior of a fuel tank is maintained at a pressure level between substantially atmospheric air pressure and positive pressure because an atmospheric air inlet causes the fuel tank to communicate with the outside, so that the pressure in the fuel tank is not more negative than that in an intake path. Therefore, evaporative fuel can always be supplied as needed. As a result, the present invention always supplies evaporative fuel of a certain concentration from the fuel tank at internal combustion engine startup during which combustion is unstable, thereby making it possible to set a proper fuel injection amount and improve the combustion stability.

According to a second aspect of the present invention, the evaporative fuel adsorbed by a canister is discharged into the fuel tank when atmospheric air is introduced into the fuel tank from the outside via the atmospheric air inlet. Therefore, the canister can be recovered to maintain its adsorptive power. Further, even if the evaporative fuel emitted from the canister differs from the evaporative fuel in the fuel tank in concentration, the fuel tank serves as a buffer. As a result, the concentration of the evaporative fuel supplied from the fuel tank to the intake path does not significantly change.

According to a third aspect of the present invention, the evaporative fuel supply from the fuel tank to the intake path is stopped when predefined operating conditions are established. Therefore, the evaporative fuel to be supplied at the next startup can be provided in the fuel tank. It is preferred that the predefined operating conditions permit an intake port to warm up and/or a catalytic device positioned in an exhaust path to warm up until it becomes active. When the intake port is warmed up, the fuel does not adhere to the wall surface while it is liquid. Satisfactory combustion can then be achieved with fuel injected from a fuel injection valve and without having to supply evaporative fuel. Further, even when unburned hydrocarbon arises after the catalytic device becomes active, it can be purified by a catalyst.

According to a fourth aspect of the present invention, the evaporative fuel emitted from the canister is supplied to the intake path after the evaporative fuel supply from the fuel tank to the intake path is stopped. Therefore, the canister's adsorptive power can be maintained by purging the canister.

According to a fifth aspect of the present invention, the evaporative fuel discharged from the canister is supplied to the intake path a predetermined period of time after the evaporative fuel supply from the fuel tank to the intake path is stopped. Thus, it is possible to prevent an air-fuel ratio feedback control operation from being interfered with by a sudden change in the evaporative fuel concentration.

According to a sixth aspect of the present invention, the above-mentioned predetermined period of time is set as the time interval between the instant at which evaporative fuel is supplied from the fuel tank to the intake path and the instant at which the evaporative fuel is taken into a combustion chamber. As a result, it is possible to purge the canister without delay and maintain the canister's adsorptive power while preventing the evaporative fuel fed from the fuel tank and the evaporative fuel discharged from the canister from being contiguous to each other in the intake path.

According to a seventh aspect of the present invention, an internal combustion engine starts up while an evaporative fuel path is filled with evaporative fuel. Therefore, it is possible to immediately supply the evaporative fuel to the internal combustion engine at startup, thereby improving the startability of the internal combustion engine.

According to an eighth aspect of the present invention, the evaporative fuel can be immediately supplied to the internal combustion engine at the next startup without wastefully leaving concentrated evaporative fuel, which is fed from the fuel tank, in the intake path. This improves the startability of the internal combustion engine.

According to a ninth aspect of the present invention, light fuel that has a low boiling point and is supplied to a fuel adsorption partly becomes spontaneously vaporized and fills the fuel adsorption device. Meanwhile, unvaporized light fuel that is supplied to the fuel adsorption device is adsorbed into many holes in a porous body within the fuel adsorption device as microscopically granulated liquid fuel. Heavy fuel having a high boiling point such as fuel other than microscopically granulated liquid fuel that is adsorbed into many holes drops down from the lower surface of the porous body. The dropped fuel returns to the fuel tank via a communication hole made in the fuel adsorption device, which serves as a fuel return device, and then mixes with the liquid fuel stored in the fuel tank. In other words, unvaporized fuel, particularly, heavy fuel that has a high boiling point and does not vaporize while the temperature is low, mixes with the liquid fuel stored in the fuel tank. This inhibits unvaporized fuel from being supplied to the internal combustion engine while it is cold.

According to a tenth aspect of the present invention, a gaseous body is brought into contact with microscopically granulated liquid fuel that is adsorbed into many holes made in the porous body within the above fuel adsorption device. In other words, light fuel that is adsorbed by the porous body, is unvaporized, and has a low boiling point comes into contact with a gaseous body, which flows into the fuel tank via the communication hole due to a negative pressure introduced into the fuel adsorption device by a negative pressure introduction device of a gaseous body inflow device. This urges the microscopically granulated liquid fuel adsorbed by the porous body to vaporize. As a result, the fuel tank is filled with evaporative fuel, which comprises fuel that is spontaneously vaporized in the fuel tank and fuel that is vaporized by a gaseous body inflow to the porous body. The fuel tank is then filled with an increased amount of evaporative fuel. Consequently, a large amount of evaporative fuel can be supplied to the internal combustion engine while it is cold.

According to an eleventh aspect of the present invention, the fuel stored in the fuel tank, particularly, liquid fuel such as unvaporized, low-boiling-point, light fuel, is adsorbed beforehand by the porous body of the fuel adsorption device while the internal combustion engine is warm, that is, the evaporative fuel in the fuel tank is not needed. When the internal combustion engine is cold so that the evaporate fuel in the fuel tank is needed, the liquid fuel adsorbed by the porous body, particularly, unvaporized light fuel, is vaporized. Consequently, while the internal combustion engine is cold, the fuel tank is filled with evaporative fuel, which comprises fuel that is spontaneously vaporized in the fuel tank and fuel that is vaporized by a gaseous body inflow to the porous body. As a result, it is possible to supply a stable amount of evaporative fuel to the internal combustion engine while it is cold.

According to a twelfth aspect of the present invention, a fuel injection device is used to inject fuel into the fuel tank. Light fuel that is atomized when injected and has a low boiling point is vaporized during an injection process. Therefore, the fuel tank is filled with evaporative fuel, which comprises fuel that is spontaneously vaporized and fuel that is vaporized by the fuel injection device. The evaporative fuel in the fuel tank is then supplied to the internal combustion engine. Meanwhile, heavy fuel that is atomized when injected and has a high boiling point and light fuel that is unvaporized continue to be microscopically granulated liquid fuel and mix with the liquid fuel stored in the fuel tank. In other words, unvaporized fuel, particularly, high-boiling-point heavy fuel that cannot vaporize while the internal combustion engine is cold, mixes with the liquid fuel stored in the fuel tank. This makes it possible to supply a large amount of evaporative fuel to the internal combustion engine while it is cold and inhibit unvaporized fuel from being supplied to the internal combustion engine while it is cold.

According to a thirteenth aspect of the present invention, liquid fuel that is vaporized when injected by the fuel injection device and is microscopically granulated is urged by a porous body or other evaporation acceleration body to become vaporized before being mixed with the liquid fuel stored in the fuel tank. In other words, microscopically granulated, low-boiling-point light liquid fuel is vaporized by the evaporation acceleration body. As a result, the fuel tank is filled with evaporative fuel, which comprises fuel that is spontaneously vaporized, fuel that is vaporized by the fuel injection device, and fuel that is vaporized by the evaporation acceleration body. It means that the fuel tank is filled with an increased amount of evaporative fuel. Consequently, an increased amount of evaporative fuel can be supplied to the internal combustion engine while it is cold.

According to a fourteenth aspect of the present invention, fuel that is injected by the fuel injection device within the fuel tank, atomized, and vaporized is temporarily adsorbed by a porous body or other evaporative fuel adsorption body. The evaporative fuel adsorption body is capable of adsorbing a fixed amount of vaporized fuel, that is, evaporative fuel. For evaporative fuel supply to the internal combustion engine, the evaporative fuel adsorbed by the evaporative fuel adsorption body is supplied. As a result, a stable amount of evaporative fuel can be supplied to the internal combustion engine.

According to a fifteenth aspect of the present invention, fuel injected by the fuel injection device and atomized is separated into vapor fuel and liquid fuel by a liquid/vapor separator. In other words, the liquid/vapor separator separates the atomized fuel into fuel vaporized by injection and microscopically granulated, unvaporized liquid fuel. Therefore, it is possible to inhibit the microscopically granulated, unvaporized liquid fuel from entering an evaporative fuel supply path via, for instance, the fuel tank wall surface. This properly inhibits unvaporized fuel from being supplied to the internal combustion engine while it is cold.

According to a sixteenth aspect of the present invention, the fuel injected from the fuel injection device becomes atomized in a low-pressure air chamber. Since the pressure in the air chamber is lower than in the fuel tank, the fuel boiling point lowers. In the air chamber, therefore, the light fuel, which has a low boiling point, is likely to vaporize, and heavy fuel, which has a high boiling point, can be partly vaporized. The vaporization of the fuel injected from the fuel injection device can be accelerated. The amount of evaporative fuel that fills the fuel tank then further increases. Therefore, an increased amount of evaporative fuel can be supplied to the internal combustion engine while it is cold.

According to a seventeenth aspect of the present invention, the negative pressure generated on the intake side of the internal combustion engine is introduced into the air chamber. The evaporative fuel in the air chamber is discharged toward the intake side of the internal combustion engine the moment the negative pressure is introduced into the air chamber. In other words, it is possible to ensure that the pressure in the air chamber is lower than in the fuel tank, and supply the evaporative fuel in the air chamber to the internal combustion engine. The number of parts required for the evaporative fuel treatment apparatus can then be minimized to minimize the increase in the production cost.

According to a eighteenth aspect of the present invention, atomized fuel can be supplied to the air chamber without using a fuel injection device or other device that pressurizes the fuel for fuel injection purposes or using a fuel injection device that requires the control of a solenoid valve or the like. This makes it possible to minimize the increase in the production cost for the evaporative fuel treatment apparatus.

According to a nineteenth aspect of the present invention, microscopically granulated liquid fuel that is injected from the fuel injection device and atomized is agitated by air whose flow velocity is increased by a venturi device or other flow velocity increase device. In other words, low-boiling-point light liquid fuel, which is microscopically granulated, is vaporized by air whose flow velocity is increased. The amount of evaporative fuel that fills the fuel tank then further increases. Therefore, an increased amount of evaporative fuel can be supplied to the internal combustion engine while it is cold.

The invention claimed is:

1. An evaporative fuel treatment apparatus for an internal combustion engine, the evaporative fuel treatment apparatus comprising:

a fuel tank for storing fuel;

an atmospheric air inlet for causing said fuel tank to communicate with the outside and for maintaining the interior of said fuel tank at a pressure level between substantially atmospheric air pressure and positive pressure;

a fuel injection device for injecting fuel into said fuel tank; and evaporative fuel supply means for causing said fuel tank to communicate with an intake path of an internal combustion during engine startup and for supplying evaporative fuel in said fuel tank to said intake path.

2. The evaporative fuel treatment apparatus for an internal combustion engine according to claim 1, wherein said atmospheric air inlet is provided with a canister that adsorbs evaporative fuel generated in said fuel tank; and wherein said fuel tank communicates with the outside via said canister.

3. The evaporative fuel treatment apparatus for an internal combustion engine according to claim 1, wherein, when predefined operating conditions are established after internal combustion engine startup, said evaporative fuel supply means stops supplying evaporative fuel from said fuel tank to said intake path.

4. The evaporative fuel treatment apparatus for an internal combustion engine according to claim 3, further comprising a canister for adsorbing evaporative fuel generated in said fuel tank, wherein said evaporative supply means supplies evaporative fuel discharged from said canister to said intake path after the evaporative fuel supply from said fuel tank to said intake path is stopped.

5. The evaporative fuel treatment apparatus for an internal combustion engine according to claim 4, wherein said evaporative fuel supply means supplies evaporative fuel discharged from said canister to said intake path a predetermined period of time after the evaporative fuel supply from said fuel tank to said intake path is stopped.

6. The evaporative fuel treatment apparatus for an internal combustion engine according to claim 5, wherein said predetermined period of time is the time interval between the instant at which evaporative fuel is supplied from said fuel tank to said intake path and the instant at which the evaporative fuel is taken into a combustion chamber.

7. The evaporative fuel treatment apparatus for an internal combustion engine according to claim 1, wherein said evaporative fuel supply means includes an evaporative fuel path, which is connected to said intake path, and a control valve, which is positioned in said evaporative fuel path, wherein, when an internal combustion engine stops, said control valve closes with said evaporative fuel path communicating with said fuel tank.

8. The evaporative fuel treatment apparatus for an internal combustion engine according to claim 4, wherein said evaporative fuel supply means includes an evaporative fuel path connected to said intake path, a control valve positioned in said evaporative fuel path, and connection change means for selectively connecting either said canister or said fuel tank to said evaporative fuel path; wherein, when an ignition switch for an internal combustion engine turns off, said connection change means changes the connection to said evaporative fuel path from said canister to said fuel tank; and wherein, when it is estimated that said evaporative fuel path is filled with evaporative fuel generated in said fuel tank, said control valve closes with said evaporative fuel path communicating with said fuel tank.

9. The evaporative fuel treatment apparatus for an internal combustion engine according to claim 1, further comprising:

a fuel adsorption device that is mounted in said fuel tank to adsorb fuel supplied from said fuel tank; and a fuel return device for returning fuel supplied to said fuel adsorption device to the fuel stored in said fuel tank.

10. The evaporative fuel treatment apparatus for an internal combustion engine according to claim 9, wherein said fuel adsorption device is internally provided with a porous body; and wherein the fuel supplied to said fuel adsorption device returns to the fuel stored in said fuel tank from said fuel return device via said porous body.

11. The evaporative fuel treatment apparatus for an internal combustion engine according to claim 9, wherein said fuel return device is a communication hole provided in said fuel adsorption device; and wherein the interior of said fuel tank communicates with the interior of said fuel adsorption device through said communication hole.

12. The evaporative fuel treatment apparatus for an internal combustion engine according to claim 11, further comprising a gaseous body inflow device for allowing a gaseous body to flow into a porous body of said fuel adsorption device.

13. The evaporative fuel treatment apparatus for an internal combustion engine according to claim 9, wherein the fuel stored in said fuel tank is supplied to said fuel adsorption device while said internal combustion engine is warm.

14. The evaporative fuel treatment apparatus for an internal combustion engine according to claim 1, wherein said fuel tank further comprises an evaporation acceleration body; and wherein the fuel injected from said fuel injection device is supplied to said internal combustion engine via said evaporation acceleration body.

15. The evaporative fuel treatment apparatus for an internal combustion engine according to claim 1, wherein said fuel tank further comprises an evaporative fuel adsorption body for adsorbing said evaporative fuel; and wherein said evaporative fuel is supplied to said internal combustion engine via said evaporative fuel adsorption body.

16. The evaporative fuel treatment apparatus for an internal combustion engine according to claim 1, wherein said fuel tank further comprises a liquid/vapor separator for separating said injected fuel into liquid and vapor; and wherein the fuel injected from said fuel injection device is supplied to said internal combustion engine via said liquid/vapor separator.

17. The evaporative fuel treatment apparatus for an internal combustion engine according to claim 1, further comprising an air chamber that is positioned between the interior of said fuel tank and an evaporative fuel supply path to said internal combustion engine and placed under a pressure lower than the pressure in said fuel tank, wherein said fuel injection device injects fuel into said air chamber.

18. The evaporative fuel treatment apparatus for an internal combustion engine according to claim 1, wherein said fuel injection device injects fuel in accordance with the difference between the pressure in said fuel tank and the pressure in said air chamber.

19. The evaporative fuel treatment apparatus for an internal combustion engine according to claim 1, further comprising a flow velocity increase device for increasing the velocity of an air flow from said fuel tank to said air chamber, wherein the fuel injected from said fuel injection device mixes with air whose flow velocity is increased by said flow velocity increase device.

* * * * *